US007364398B2

(12) United States Patent
Michler et al.

(10) Patent No.: US 7,364,398 B2
(45) Date of Patent: Apr. 29, 2008

(54) APPARATUS AND METHOD FOR STACKING SHEETS DISCHARGED FROM A STARWHEEL ASSEMBLY

(75) Inventors: James R. Michler, Ashland, WI (US); Jeffrey A. Gendron, Ashland, WI (US); Dennis P. Couturier, Washburn, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 0 days.

(21) Appl. No.: 10/996,107

(22) Filed: Nov. 23, 2004

(65) Prior Publication Data

US 2005/0087925 A1 Apr. 28, 2005

Related U.S. Application Data

(62) Division of application No. 09/917,179, filed on Jul. 27, 2001, now Pat. No. 6,832,886.

(51) Int. Cl.
*B65G 57/00* (2006.01)
*B65G 43/00* (2006.01)
*B65H 31/12* (2006.01)

(52) U.S. Cl. ..... 414/789.9; 414/790; 414/790.6; 414/798.2; 198/444; 271/218

(58) Field of Classification Search ..... 414/789.9, 414/788.7, 790.1, 790.6, 790.7, 790.9, 793.1, 414/794.7, 788.1; 198/459.2, 459.1, 457.03, 198/461.1, 461.2, 363
See application file for complete search history.

(56) References Cited

U.S. PATENT DOCUMENTS 950,014 A 2/1910 Boyce
1,425,556 A * 8/1922 Tingwall et al. ..... 198/363
1,586,544 A 6/1926 White
1,701,760 A 2/1929 Paffen
1,845,895 A 2/1932 Voorhis
1,991,411 A 2/1935 Novick
1,992,179 A 2/1935 Blosser et al.
2,011,236 A 8/1935 Winter et al.
2,016,309 A 10/1935 Zuckerman
2,109,050 A 2/1938 Quick et al.

(Continued)

FOREIGN PATENT DOCUMENTS

AT 219396 1/1962

(Continued)

*Primary Examiner*—James Keenan
*Assistant Examiner*—Gregory W Adams
(74) *Attorney, Agent, or Firm*—Reinhart Boerner Van Deuren P.C.

(57) ABSTRACT

An apparatus and method for moving stacks of product discharged from a stacking device. The apparatus includes a first conveyor movable at a first speed and a second conveyor movable at a second speed. The first conveyor includes an upstream end adjacent to the stacking device. The first conveyor is positioned to receive product from the stacking device. The second conveyor includes an upstream end adjacent to the stacking device. The second conveyor is positioned to receive product from the stacking device. The running speed of the first conveyor is faster than the running speed of the second conveyor to move stacks of product on the first conveyor away from the stacking device at a faster speed than stacks of product on the second conveyor.

14 Claims, 13 Drawing Sheets

U.S. PATENT DOCUMENTS

| | | | | |
|---|---|---|---|---|
| 2,631,845 | A | | 3/1953 | Zuckerman |
| 2,775,171 | A | | 12/1956 | Steen et al. |
| 2,787,468 | A | | 4/1957 | Novick |
| 2,929,624 | A | | 3/1960 | Brooker |
| 2,954,881 | A | | 10/1960 | Hopton et al. |
| 2,981,411 | A | | 4/1961 | Azari |
| 3,019,886 | A | | 2/1962 | Winkler et al. |
| 3,044,228 | A | | 7/1962 | Peterson |
| 3,088,604 | A | | 5/1963 | Nilsson |
| 3,163,413 | A | | 12/1964 | Franke et al. |
| 3,207,361 | A | | 9/1965 | Marcalus |
| 3,213,734 | A | | 10/1965 | Nystrand |
| 3,223,225 | A | * | 12/1965 | Clark et al. ..... 198/357 |
| 3,254,889 | A | | 6/1966 | Nystrand |
| 3,256,012 | A | | 6/1966 | Bradley |
| 3,279,664 | A | | 10/1966 | Lynch |
| 3,279,792 | A | | 10/1966 | Kostal et al. |
| 3,292,470 | A | | 12/1966 | Nystrand et al. |
| 3,298,683 | A | * | 1/1967 | Stroud ..... 271/218 |
| 3,313,538 | A | | 4/1967 | Isii |
| 3,331,183 | A | | 7/1967 | Gass |
| 3,347,367 | A | | 10/1967 | Smith |
| 3,351,215 | A | | 11/1967 | Kitch |
| 3,414,138 | A | | 12/1968 | Jünemann et al. |
| 3,418,895 | A | | 12/1968 | Palmer |
| 3,479,932 | A | | 11/1969 | Stal et al. |
| 3,531,108 | A | | 9/1970 | Rabinow et al. |
| 3,552,828 | A | | 1/1971 | Lawrence et al. |
| 3,557,688 | A | | 1/1971 | Hartbauer et al. |
| 3,624,723 | A | | 11/1971 | Cannon |
| 3,643,555 | A | | 2/1972 | Ehlscheid |
| 3,643,816 | A | | 2/1972 | Jacobsen |
| 3,656,271 | A | | 4/1972 | O'Shea et al. |
| 3,675,792 | A | | 7/1972 | Griner et al. |
| 3,689,061 | A | | 9/1972 | Nystrand |
| 3,724,640 | A | | 4/1973 | Rapparlie |
| 3,729,886 | A | | 5/1973 | Lucas et al. |
| 3,739,886 | A | | 6/1973 | Kertzman |
| 3,740,049 | A | | 6/1973 | Fischer |
| 3,752,043 | A | | 8/1973 | Rapparlie et al. |
| 3,758,381 | A | | 9/1973 | Knoke |
| RE27,765 | E | | 10/1973 | Salomon |
| 3,766,701 | A | | 10/1973 | Besserdich et al. |
| 3,773,322 | A | | 11/1973 | Schlagbauer et al. |
| 3,784,187 | A | | 1/1974 | Takayanagi et al. |
| 3,784,188 | A | | 1/1974 | De Ligt |
| 3,788,636 | A | | 1/1974 | Rehm et al. |
| 3,822,009 | A | * | 7/1974 | Richards ..... 198/444 |
| 3,834,689 | A | | 9/1974 | Lee et al. |
| 3,866,905 | A | | 2/1975 | Trogan et al. |
| 3,870,292 | A | | 3/1975 | Bradley |
| 3,902,587 | A | | 9/1975 | Cheoccucci |
| 3,905,260 | A | | 9/1975 | Nystrand |
| 3,948,504 | A | | 4/1976 | Woessner et al. |
| 3,977,152 | A | | 8/1976 | Rochla et al. |
| 3,980,183 | A | | 9/1976 | Anikanov et al. |
| 3,995,748 | A | | 12/1976 | Looney |
| 4,029,310 | A | | 6/1977 | Reist |
| 4,070,014 | A | | 1/1978 | Takahashi |
| 4,102,253 | A | | 7/1978 | Gannicott |
| 4,125,253 | A | | 11/1978 | Wangermann |
| 4,141,443 | A | * | 2/1979 | Halsey ..... 198/483.1 |
| 4,162,733 | A | | 7/1979 | Wiseman |
| 4,173,846 | A | | 11/1979 | Steiner et al. |
| 4,181,213 | A | | 1/1980 | Deutschlander et al. |
| 4,183,704 | A | | 1/1980 | Steinhart |
| 4,190,242 | A | | 2/1980 | Bolza-Schunemann |
| 4,215,774 | A | * | 8/1980 | Manservisi ..... 198/444 |
| 4,229,134 | A | | 10/1980 | Reist |
| 4,269,555 | A | | 5/1981 | Franks |
| 4,279,410 | A | | 7/1981 | Bolza-Schünemann |
| 4,285,621 | A | | 8/1981 | Spencer |
| 4,311,475 | A | | 1/1982 | Imai |
| 4,314,785 | A | | 2/1982 | LaFleur, Jr. et al. |
| 4,332,582 | A | | 6/1982 | Hertrich |
| 4,349,185 | A | | 9/1982 | Small et al. |
| 4,357,126 | A | | 11/1982 | Kidd et al. |
| 4,391,596 | A | | 7/1983 | Fischer |
| 4,396,336 | A | | 8/1983 | Malamood |
| 4,406,650 | A | | 9/1983 | Felix |
| 4,441,703 | A | | 4/1984 | Faltin |
| 4,460,169 | A | | 7/1984 | Bartesaghi |
| 4,470,590 | A | | 9/1984 | Ariga et al. |
| 4,474,521 | A | | 10/1984 | Jaton |
| 4,475,730 | A | | 10/1984 | Trogan |
| 4,494,741 | A | | 1/1985 | Fischer et al. |
| 4,501,418 | A | | 2/1985 | Ariga et al. |
| 4,506,882 | A | | 3/1985 | Ito et al. |
| 4,508,527 | A | | 4/1985 | Uno et al. |
| 4,511,136 | A | | 4/1985 | Yamada et al. |
| 4,521,008 | A | | 6/1985 | Granzow et al. |
| 4,522,387 | A | | 6/1985 | Leuthold |
| 4,526,266 | A | * | 7/1985 | Dietz ..... 198/357 |
| 4,530,694 | A | | 7/1985 | Köbler et al. |
| 4,534,552 | A | | 8/1985 | Rahe |
| 4,537,390 | A | | 8/1985 | Kiamco et al. |
| 4,552,351 | A | | 11/1985 | Tsukamoto |
| 4,565,363 | A | | 1/1986 | Faltin |
| 4,577,852 | A | | 3/1986 | Grunder |
| 4,584,917 | A | | 4/1986 | Blom |
| 4,593,896 | A | | 6/1986 | Nakamura |
| 4,595,193 | A | | 6/1986 | Nakamura |
| 4,603,849 | A | | 8/1986 | Nakamura |
| 4,613,268 | A | | 9/1986 | Capdeboscq et al. |
| 4,625,957 | A | | 12/1986 | DuFresne |
| 4,629,174 | A | | 12/1986 | Wakisaka et al. |
| 4,650,447 | A | | 3/1987 | Meschi |
| 4,669,644 | A | | 6/1987 | Nilsson |
| 4,673,382 | A | | 6/1987 | Buck et al. |
| 4,700,939 | A | | 10/1987 | Hathaway |
| 4,714,394 | A | * | 12/1987 | Ehlscheid et al. ..... 414/789.6 |
| 4,717,135 | A | | 1/1988 | Hathaway |
| 4,721,295 | A | | 1/1988 | Hathaway |
| 4,736,936 | A | | 4/1988 | Hertel et al. |
| 4,751,807 | A | | 6/1988 | Couturier |
| 4,762,313 | A | | 8/1988 | Nilsson |
| 4,770,402 | A | | 9/1988 | Couturier |
| RE32,872 | E | | 2/1989 | Buck |
| 4,821,613 | A | | 4/1989 | Hertel |
| 4,824,307 | A | | 4/1989 | Johnson et al. |
| 4,824,426 | A | | 4/1989 | DuFresne |
| 4,846,454 | A | | 7/1989 | Parkander |
| 4,874,158 | A | | 10/1989 | Retzloff |
| 4,915,371 | A | | 4/1990 | Quinton |
| 4,925,173 | A | | 5/1990 | Lindblom et al. |
| 4,925,179 | A | | 5/1990 | Breton et al. |
| 4,930,977 | A | | 6/1990 | Beeman et al. |
| 4,938,465 | A | | 7/1990 | Marsiletti |
| 4,948,112 | A | | 8/1990 | Sato et al. |
| 4,977,803 | A | | 12/1990 | Blom |
| 4,979,727 | A | | 12/1990 | Koike et al. |
| 4,997,338 | A | | 3/1991 | Couturier et al. |
| 5,000,437 | A | | 3/1991 | Schneider et al. |
| 5,038,647 | A | | 8/1991 | Biagiotti |
| 5,040,663 | A | | 8/1991 | Gould et al. |
| 5,040,783 | A | | 8/1991 | Ruehl |
| 5,049,123 | A | | 9/1991 | Breton et al. |
| 5,074,735 | A | | 12/1991 | Stock |
| 5,076,559 | A | | 12/1991 | Lawniczak |
| 5,083,998 | A | | 1/1992 | Carter |
| 5,088,707 | A | | 2/1992 | Stemmler |
| 5,088,720 | A | | 2/1992 | Beeman et al. |
| 5,094,337 | A | * | 3/1992 | van Veldhuisen et al. .. 198/357 |
| 5,101,963 | A | | 4/1992 | Skarlupka et al. |

5,114,306 A 5/1992 Sjogren et al.
5,120,049 A 6/1992 Fischer
5,125,645 A 6/1992 Eberle
5,152,203 A 10/1992 Wierschke
5,184,712 A * 2/1993 Leypold et al. ..... 198/449
5,188,212 A 2/1993 Munsch
5,201,700 A 4/1993 Meschi
5,217,220 A 6/1993 Carlson et al.
5,242,367 A 9/1993 Marmin
5,249,791 A 10/1993 Belanger et al.
5,261,655 A 11/1993 Keller et al.
5,289,747 A 3/1994 Wunderlich
5,290,141 A 3/1994 Grinager
5,299,793 A 4/1994 Couturier
5,315,907 A 5/1994 Biagiotti
5,322,270 A 6/1994 Belanger et al.
5,324,014 A 6/1994 Honegger et al.
5,356,131 A 10/1994 Mauro
5,359,929 A 11/1994 Hansen
5,359,930 A 11/1994 Hansen
5,405,126 A 4/1995 Mack
5,425,697 A 6/1995 Lanvin
5,454,687 A 10/1995 Johnson et al.
5,458,033 A 10/1995 Wierschke
5,460,258 A 10/1995 Tisma
5,464,316 A 11/1995 Kranz
5,485,992 A 1/1996 Albert et al.
5,503,518 A 4/1996 Scholz
5,518,230 A 5/1996 Scarlata et al.
5,522,292 A 6/1996 Biagiotti
5,524,876 A 6/1996 Porter
5,551,678 A 9/1996 Michalik et al.
5,558,488 A 9/1996 Gentry
5,579,894 A 12/1996 Glazier et al.
5,597,285 A 1/1997 Meyer et al.
5,611,530 A 3/1997 Maresse et al.
5,620,081 A 4/1997 Kivits
5,630,584 A 5/1997 Seeber
5,639,083 A 6/1997 Doucet
5,647,586 A 7/1997 Novick et al.
5,690,328 A 11/1997 Herda et al.
5,692,740 A 12/1997 Holtje
5,730,435 A 3/1998 Belanger et al.
5,730,695 A 3/1998 Hauschild et al.
5,732,623 A 3/1998 Compera et al.
5,746,568 A * 5/1998 Ogawa et al. ..... 414/789.6
5,772,391 A 6/1998 Sjogren et al.
5,775,682 A 7/1998 Hosking et al.
5,782,332 A * 7/1998 Guidetti et al. ..... 198/357
5,803,705 A 9/1998 Keyes
5,820,122 A 10/1998 Schneider
5,894,937 A 4/1999 Schmidt
5,899,447 A 5/1999 Muckenfuhs
5,899,448 A 5/1999 Hosking
5,927,712 A 7/1999 Curley et al.
5,975,273 A 11/1999 Zwahlen et al.
5,975,525 A 11/1999 Hartmann et al.
6,000,334 A 12/1999 Suzuki
6,254,522 B1 7/2001 Schmidt

FOREIGN PATENT DOCUMENTS

DE 372031 3/1923
DE 442935 4/1927
DE 719833 4/1942
DE 3700930 7/1988
EP 0561100 9/1993
FR 755348 11/1933
FR 1215073 4/1960
GB 321873 11/1929
GB 513171 10/1939
GB 1479299 7/1977
IT 646301 2/1966
JP 01288562 11/1989
SE 116974 8/1946

* cited by examiner

APPARATUS AND METHOD FOR STACKING SHEETS DISCHARGED FROM A STARWHEEL ASSEMBLY

CROSS-REFERENCE TO RELATED APPLICATIONS

This application is a divisional application of U.S. application Ser. No. 09/917,179, filed Jul. 27, 2001, now U.S. Pat. No. 6,832,886 the entire contents of which are hereby incorporated by reference herein.

FIELD OF THE INVENTION

The invention relates to stacking sheets that are discharged from a starwheel assembly, and more specifically, to apparatuses and methods for continuously stacking discharged sheets without interrupting the rotation of the starwheel assembly.

BACKGROUND OF THE INVENTION

Many stacking devices are used to continuously create stacks of sheet products. In one common stacking device, the sheets are fed from a feeding system to the top of a wheel that is rotated about a wheel axis. The wheel includes a plurality of spiraled wheel blades or fins that project in a direction opposite to the direction of rotation. The sheets are fed between two adjacent fins and are rotated within the wheel to a lower position where the paper is stripped from the wheel by a barrier. The stripped sheets fall away from the wheel onto a stacking plate located at the bottom of a stacking box. Different separators have been developed to separate two adjacent sheets being discharged from the wheel. The two adjacent sheets include a sheet that completes the stack of a specified number located in the stacking box and another sheet that begins a new stack on the separator.

For example, some stacking devices rotate a separator about an axis that is displaced from the wheel axis but within the periphery of the wheel. The separator is rotated into a position between a first fed sheet that has just been fed into the wheel and an adjacent second sheet that will be fed into the wheel behind the separator as the wheel and separator rotate in the same direction. The separator rotates to the stacking position where the separator allows the first fed sheet to complete the stack located in the stacking box and supports the second fed sheet to begin a new stack at a position above the stacking plate of the stacking box. The separator accumulates additional sheets of the new stack to allow the completed stack to be sent to downstream operations, such as a packaging or bundling unit. When the stacking plate of the stacking box is cleared and ready to receive the new sheets accumulated by the separator, the separator rotates through the stacking box causing the sheets to fall onto the stacking plate located at the bottom of the stacking box.

In the above-described device, the separator can strike the sheets that are not fully seated between the blades because the travel path of the separator intersects with the travel path of the blades. This undesirable contact is caused by rotating the separator about a different rotational axis than the wheel axis which causes portions of the path traveled by the separator to intersect the path traveled by the sheets carried on the wheel.

Another type of conventional stacking device rotates a separator about the same axis as the wheel axis. The separator is coupled by an arm to the wheel axis, however the separator is at all times located outside a cylindrical volume that is defined by the periphery of the wheel. The separator rotates to a stacking position between a first sheet has been discharged from the wheel into the stacking box and a second sheet that is still located within the wheel. The separator allows the first sheet to fall to complete the stack located on a stacking plate in the stacking box while the separator supports the second sheet above the completed stack as it is discharged from the wheel. The separator will support additional sheets while the stacking plate moves the completed stack to another location. The separator is limited to supporting only as many sheets as space permits because the separator is located a fixed distance from the periphery of the wheel. After the stacking plate returns to the stacking box and the stacking box is ready to accept the partially completed stack from the separator, the separator is rotated about the common axis. As the separator is rotated the barrier will strip the sheets from the separator and the sheets will fall onto the stacking plate that is located at the bottom of the stacking box.

Another type of conventional separating device includes a separator that rotates about the wheel axis and moves radially away from the wheel axis once it is in the stacking position in order to accumulate additional sheets. The separator is rotated into a position between a first sheet that has just been fed into the wheel and a second sheet that will be fed into the wheel behind the separator as the wheel and separator rotate at the same speed about the common axis. The separator is rotated with the wheel until the separator is located at the stacking position beneath the wheel. The separator allows the first sheet to fall and complete the stack positioned on the stacking plate of the stacking box and supports the second sheet to begin the new stack on the separator. The separator finger moves radially away from the wheel to support additional sheets. Moving away from the wheel creates additional space to allow the separator to support more sheets than would be possible with a separator that did not move radially from the wheel. The stacking plate therefore has more time to move the completed stack because the separator can support an increased number of sheets before they must be transferred onto the stacking plate of the stacking box. When the stacking plate returns to the stacking box and is ready to accept the stack from the separator, the separator will rotate causing the barrier to push the sheets from the separator. The sheets then fall onto the stacking plate that is located at the bottom of the stacking box.

Separators that are rotatably connected to the wheel axis often require a complex design that is limited in space about the axis of rotation of the wheel. The complexity of this configuration increases the cost of manufacturing and assembly costs associated with the separator. Inaccessibility of the components of such an intricate and compact design also tends to increase the maintenance and repair costs of the separator.

In light of the above design requirements and limitations, a need exists for an apparatus that discharges sheets from a starwheel assembly which provides a separator that controllably moves between two adjacent sheets within the wheel without adversely affecting the position or movement of the sheets within the starwheel assembly, provides a separator that moves efficiently to enable the use of a simpler and less costly design, and provides a separator that is mounted to the frame outside of a cylindrical volume that is defined by the periphery of the wheel to simplify the design and manufacture, thereby minimizing manufacturing costs, maintenance costs, and repairs costs. Each preferred embodiment of the present invention achieves one or more of these results.

SUMMARY OF THE INVENTION

In some preferred embodiments of the present invention, an apparatus and method are employed for discharging sheets from a starwheel assembly utilized for creating stacks of a desired number of sheets without interrupting the rotation of the starwheel assembly. Some embodiments of the present invention preferably separate sheets such that one separated sheet is allowed to fall and complete a stack and the other separated sheet is supported by a separator to begin a new stack. Preferably, the completed stack is transported away from the starwheel assembly by a conveyor as the new stack supports additional sheets that are discharged from the starwheel assembly. More preferably, the new stack will lower to provide clearance from the starwheel assembly to accumulate the additionally discharged sheets. The apparatus for discharging sheets preferably allows for cyclical repetition of the separation of the sheets, the stacking of the sheets, and the transportation of the stacks such that the continual rotation of the starwheel assembly is not interrupted.

In some highly preferred embodiments of the present invention, the apparatus for discharging sheets from a starwheel assembly includes a barrier and a first separator finger. Preferably, the barrier is positioned adjacent to the starwheel assembly to discharge the sheets from the starwheel assembly. The first separator finger is movable and is preferably inserted between two adjacent sheets that are positioned within the starwheel assembly. More preferably, the first separator finger separates a first sheet of the two adjacent sheets from a second sheet of the two adjacent sheets. Even more preferably, the first separator finger supports a first sheet of the two adjacent sheets to begin a first stack upon the first separator finger and allows the second sheet of the two adjacent sheets to complete another stack.

In one preferred embodiment of the present invention, the apparatus for stacking discharged sheets from a starwheel assembly includes a second separator finger. The second separator finger preferably works in coordination with the first separator finger to alternately separate adjacent sheets and support one of the separated sheets to create a second stack. The second separator finger is movable and preferably is inserted between a second set of two adjacent sheets that are positioned within the starwheel assembly. More preferably, the second separator finger separates a first sheet of the second set of two adjacent sheets from a second sheet of the second set of two adjacent sheets. Even more preferably, the second separator finger supports the first sheet of the second set of two adjacent sheets to begin a second stack upon the second separator finger and allows the second sheet of the second set of two adjacent sheets to complete the first stack on the first separator finger.

In another preferred embodiment of the present invention, the apparatus for discharging sheets from a starwheel assembly includes the first separator finger and a movable conveyor. The movable conveyor preferably works in coordination with the first separator finger to receive and support the first stack from the first separator finger. Preferably, the movable conveyor moves toward the starwheel assembly to receive the partially completed first stack from the first separator finger. More preferably, the movable conveyor also moves away from the starwheel assembly axis to accommodate additional discharged sheets on the first stack. Preferably, the first separator finger is re-inserted between a second set of two adjacent sheets that are positioned within the starwheel assembly. The first separator finger can separate a first sheet of the second set of two adjacent sheets from a second sheet of the second set of two adjacent sheets. Also, the first separator finger preferably supports the first sheet of the second set of two adjacent sheets to begin a second stack upon the first separator finger and allows the second sheet of the second set of two adjacent sheets to complete the first stack on the movable conveyor. The movable conveyor carries the completed first stack away from the starwheel assembly while the first separator finger is accumulating intermediate sheets on the second stack.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numerals indicate like parts.

DETAILED DESCRIPTION OF PREFERRED EMBODIMENTS

Figure 1:
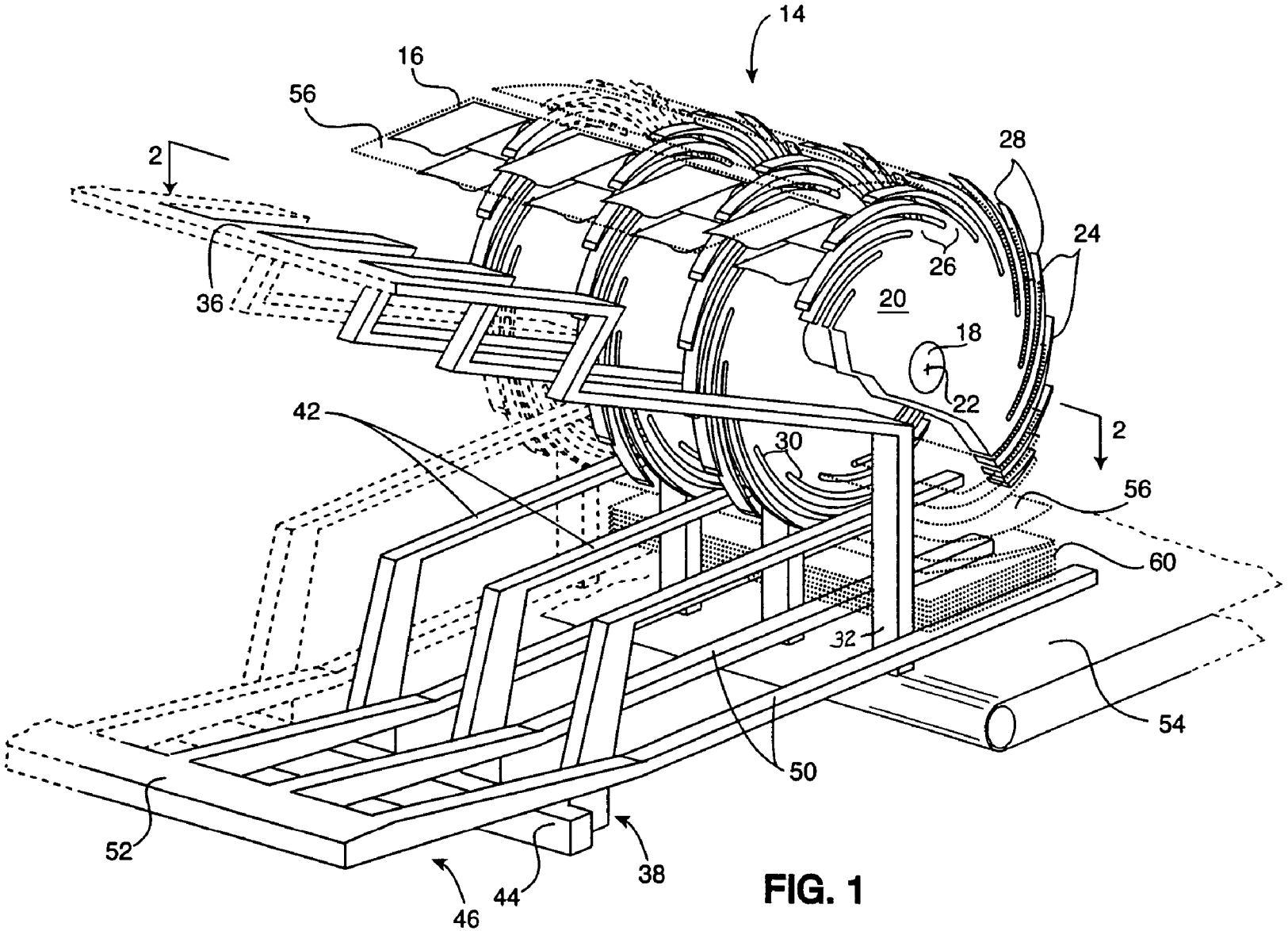
FIG. 1 is a perspective view of an apparatus for stacking sheets that are discharged from a starwheel assembly.

FIG. 1 illustrates an apparatus for stacking sheets 10 that are discharged from a starwheel assembly 14 embodying features of the present invention. The stacking apparatus 10 includes a frame (not shown) and a starwheel assembly 14.

The starwheel assembly 14 rotates to accept sheets from a feeding system 16 and discharge the accepted sheets in another location. The starwheel assembly 14 preferably includes a shaft 18 and a plurality of starwheels 20. The shaft 18 is rotatably coupled to the frame about an axis 22 and is rotated by a motor (not shown) either directly or indirectly (e.g., via one or more gears, belts, chains, and the like driven by the motor, folding rolls, or other associated equipment).

Each starwheel 20 is preferably coupled to the shaft 18 such that the rotational axis 22 of the shaft 18 is located at the center of each starwheel 20. Preferably, each starwheel 20 is disk shaped and generally defines a diameter and a thickness. Alternatively, one or more starwheels 20 can comprise rods or other elongated structures of a generally star-shaped structure. Still other starwheel shapes are possible, each having a number of slots, grooves, recesses, or other types of apertures capable of receiving sheets of product therein for transport as the starwheels rotate. In some highly preferred embodiments, each starwheel 20 is preferably the same size and thickness.

Each starwheel 20 of the starwheel assembly 14 preferably includes a plurality of fins 24 that project from the center of each starwheel 20. More preferably, each fin 24 includes a base 26 and a tip 28. The tip 28 is positioned at a farther radial distance from the center of the starwheel 20 than the base 26. The fins 24 are preferably the same uniform thickness as the starwheel 20. The fins 24 are preferably widest at the base 26 and narrow to a point at the tip 28. In addition, the fins 24 preferably spiral in a uniform direction opposite to the direction of rotation and overlap with adjacent fins 24 such that slots 30 are formed between two adjacent fins 24. Each slot 30 preferably spirals in the same direction as the direction of the fins 24, and is narrowest adjacent to the base 26 of the fin 24 and widest at the tip 28 of the fin 24. The slots 30 receive the sheets from the feeding system 16 and support the sheets within the starwheel assembly 14 until a force causes the sheets to be removed from the slots 30.

The size, shape, and number of fins 24 included on each starwheel 20 can be varied. For example, each starwheel 20 can include as few as two fins 24 and as many as structurally possible. The fins 24 can also project straight from the body of the starwheel 20 or can be partially straight and partially curved. The fins 24 can have a uniform width or can even become wider instead of tapering as they extend away from the center of the starwheel 20. The fins 24 can also be thinner or thicker than the thickness of the starwheel 20. The configuration of the slots 30 are also variable to the extent the slots 30 are dependent upon the shape and number of the fins 24.

The starwheel assembly 14 is not limited to having any particular number of starwheels 20, and can include one starwheel 20 or more than two starwheels 20 as may be required to support and convey larger sized sheets. When the starwheel assembly 14 includes more than one starwheel 20, it is preferable that each starwheel 20 includes the same number and configuration of fins 24 and slots 30. Even more preferably, each starwheel 20 is coupled to the shaft 18 such that the fins 24 and slots 30 are oriented in the same angular position relative to the axis 22 (or preferably at least at substantially the same angular position in order to properly receive sheet product between the fins 24 of multiple starwheels 20. It should be noted that the starwheels can be different shapes, sizes or thicknesses as desired.

The stacking apparatus 10 also includes a barrier 32 that contacts sheets that are within the slots 30 as the starwheel assembly 14 rotates. The barrier 32 provides a force against one end of the sheet such that the sheet discharges from the starwheel assembly 14 as the fin 24 on which the sheet rests continues to rotate past the barrier 32. The barrier 32 is preferably stationary and preferably extends in a preferably radial direction below the axis 22 of rotation. The barrier 32 alternatively can be positioned at any angular location within the starwheel assembly 14. The barrier 32 can also be any shape that can provide a contact surface or point against which the sheets within the starwheel assembly 14 abut, such as a pin, rod, plate, wedge, or tensioned wire. If desired, the barrier 32 can also be moveable to discharge sheets from different angular positions about the axis 22 of the starwheel assembly 14.

The barrier 32 is preferably coupled to the frame and is positioned between adjacent starwheels 20. In some embodiments having multiple starwheels 20 for conveying sheets, there can be fewer or more barriers 32 than spaces between starwheels 20. Accordingly, more than one barrier 32 or no barrier 32 can be located between adjacent starwheels 20 in the starwheel assembly 14. However, at least one barrier 32 is preferably located between or adjacent to each starwheel 20 or starwheel set used to received and convey a sheet. The barrier 32 preferably can be mounted to the frame through a linkage (not shown) or through any other structure capable of holding the barrier 32 in place. Preferably, all of the barriers 32 located between adjacent starwheels 20 of the starwheel assembly 14 are connected by a common support 36 which is connected to the frame. In the illustrated preferred embodiment, the linkage extends to the outside of the starwheel assembly 14. Alternatively, the barrier 32 can be coupled to the shaft 18 in a conventional manner such that the barrier 32 does not rotate with the shaft 18. This can be accomplished by providing a non-rotating collar about the rotating shaft 18. Also, the barrier 32 can be weighted and mounted by a bearing that is connected to the rotating shaft 18 such that the barrier 32 is rotatable relative to the shaft 18 and biased by gravity toward the depending position.

It should be noted that throughout the specification and claims herein, when an element is said to be "within" the starwheel assembly 14, it does not necessarily mean that the element is positioned within the slot 30 of the starwheel 20 on the starwheel assembly 14. Instead, something is "within" the starwheel assembly 14 when the element or a substantial portion of the element is partially or fully located within a cylindrical volume that is defined by the periphery of the starwheel 20 or starwheels 20 of the starwheel assembly 14 and that projects in a direction that is parallel to the axis 22 of rotation. Likewise, when an element is described as being "outside" of the starwheel assembly 14, the element or a substantial portion of the element is located outside of the cylindrical volume. By way of example, the farthest radially extending point located on the fins 24 during rotation of the starwheel or starwheels 20 are located within the starwheel assembly 14.

The barrier 32 in part defines an area referred to as the drop-zone. The drop-zone is defined by an area projecting from the starwheel assembly axis 22 in which the sheets are discharged from the starwheel assembly 14 and stacked in a stack. Preferably, the drop-zone encompasses the area on the upstream side of the barrier 32. More preferably, the drop-zone extends a radial distance past the circumference of the starwheel assembly 14 that is greater than or substantially equal to the height of a stack of sheets.

The stacking apparatus 10 is not required to be oriented such that the barrier 32 is located directly below the axis 22 of the starwheel assembly 14 and the feeding system 16 is positioned directly above the starwheel assembly 14. The feeding system 16 and the barrier 32 can be positioned at any angular location about the axis 22 independent of each other. For example, the feeding system 16 can be positioned to insert the sheets into the starwheel assembly 14 at the ten o'clock position and the barrier 32 can be positioned in the three o'clock position such that the sheets can be discharged from the starwheel assembly 14 in a vertical orientation and stacked in a horizontal direction.

The stacking apparatus 10 includes a movable separator finger 38 that separates adjacent sheets within the starwheel assembly 14. In some highly preferred embodiments such as those shown in the figures, the separator finger 38 is movable into and out of the drop-zone. The separator finger 38 is preferably coupled at one end to a linkage (not shown) that is coupled to the frame at a position located outside of the starwheel assembly 14. The linkage is preferably adapted to move the separator finger 38 in two dimensions defining a plane that is perpendicular to the axis 22 of rotation. The linkage and separator finger 38 can be actuated to move in this manner using a number of elements and devices well known to those skilled in the art, each of which falls within the spirit and scope of the present invention.

For example, the separator finger 38 can be connected to a horizontal actuator and a vertical actuator so that the separator finger 38 can be movable through a range of positions in a plane. The range of positions can be defined by the ranges of movement of the vertical and horizontal actuators and/or by the limitations of movement placed upon these actuators by conventional controller coupled thereto. One having ordinary skill in the art will appreciate that by controlling the vertical and horizontal actuators, the separator finger 38 can preferably be placed in any position in the aforementioned plane and can preferably be moved through any desired path in the plane. Although such a range of movement is highly preferred, this range of movement can be limited in any fashion in other embodiments as desired (e.g., limited from a region in the plane, limited horizontally or vertically, and the like. In some preferred embodiments, the separator finger 38 is movable through a quadrangular path by actuation of the vertical and horizontal actuators. In other embodiments, the separator finger 38 is movable through a closed path defining a triangular or other polygonal shape, an ellipse, circle, oval, or other curved path (including unusually shaped or complex curved paths), a path having any combination of straight and curved portions, and the like.

The area bounded by the path of motion of the separator finger 38 preferably intersects the cylindrical volume of the starwheel assembly 14 so that the separator finger 38 is allowed to move within the starwheel assembly 14. Also, the separator finger 38 can be moved by actuating either the vertical or horizontal actuators in a series of actuations, by actuating the vertical and horizontal actuators at the same time or at substantially the same time, or by actuating either or both of these actuators as needed to generate the desired direction and path of finger movement.

The actuators are preferably conventional in nature, such as ball screws, linear bearings, motor-driven belts, chains, or cables, magnetic rails, linear motors, rack and pinion assemblies, hydraulic or pneumatic pistons, solenoids, or the like. One having ordinary skill in the art will appreciate that still other elements and assemblies for moving the separator finger 38 through a desired path are possible and fall within the spirit and scope of the present invention. In some embodiments, the separator finger 38 is capable of moving (via the actuators connected thereto) through a programmed series of movements, velocities, and accelerations in multiple directions as will be discussed further below.

In the illustrated preferred embodiment, the separator finger 38 includes a plurality of fingers 42 that extend in parallel directions relative to each other. The fingers 42 are preferably straight rectangular bars that are connected together by a cross member 44. The fingers 42 are preferably spaced such that when the separator finger 38 is inserted into the starwheel assembly 14 at least one finger 42 is located between adjacent starwheels 20. The separator finger 38 can also include at least one finger 42 that is positioned outside of the end starwheel 20 (or at least one finger 42 positioned outside each end of the starwheel 20). The fingers 42 of the separator finger 38 are configured to support the sheets that are discharged from the starwheel assembly 14.

Alternatively, the separator finger 38 can include as few as a single finger 42 that is insertable between two adjacent starwheels 20 of the starwheel assembly 14. In some embodiments, two or more separator fingers 42 are received between adjacent starwheels 20 of the starwheel assembly 14. If a single starwheel 20 is used in the starwheel assembly 14, one or more fingers 42 can be positioned outside of the starwheel 20 in an even or uneven manner. As long as at least one finger 38 is employed as described herein, any number of fingers 38 (including no fingers 38) can be received within each space defined between adjacent starwheels 20 in the starwheel assembly 14 and outboard of the end starwheels 20 in the starwheel assembly 14. The fingers 38 can occupy each space between the starwheels 20 or can occupy the spaces between the starwheels 20 in any pattern or in no pattern as desired.

The shape of the fingers 42 can vary to support the sheets discharged from the starwheel assembly 14. For example, the finger 42 can be a pin, a horizontal plate, a rod, a beam or the like. The fingers 42 can also be curved, bent, angled or any combination thereof.

In some embodiments of the invention, the stacking apparatus 10 includes a second separator finger 46 for separating adjacent sheets within the starwheel assembly 14 independent of the first separator finger 38. The second separator finger 46 preferably includes a linkage (not shown), fingers 50, and a cross member 52 similar to the first separator finger 38. The second separator finger 46 is preferably moveable into and out of the drop-zone. Preferably, the second separator finger 46 is similarly attached to the frame and is capable of two dimensional movements that are preferably (but not necessarily) the same as the first separator finger 38. The first and second separator fingers 38, 46 are preferably movable independent of each other and are capable of overlapping motions (with reference to the side view of the apparatus as shown in FIGS. 4-11 and 19-22) without interference. The first and second separator fingers 38, 46 can have different configurations. For example, the separator fingers 38, 46 can include different sized fingers or include different numbers of fingers.

The barrier 32, the first separator finger 38, and the second separator finger 46 are mounted such that overlapping movement between the first separator finger 42, the second separator finger 38, 46, and the barrier 32 can be accomplished without interference. Preferably, this is accomplished by mounting the fingers 42, 50 of the first and second separator fingers 38, 46 to cross-members 44, 52 that are positioned outside of the range of overlapping motion and positioning the fingers 42, 50 such that they are spaced at different lateral locations from the barriers 32 and each other.

Figure 3:
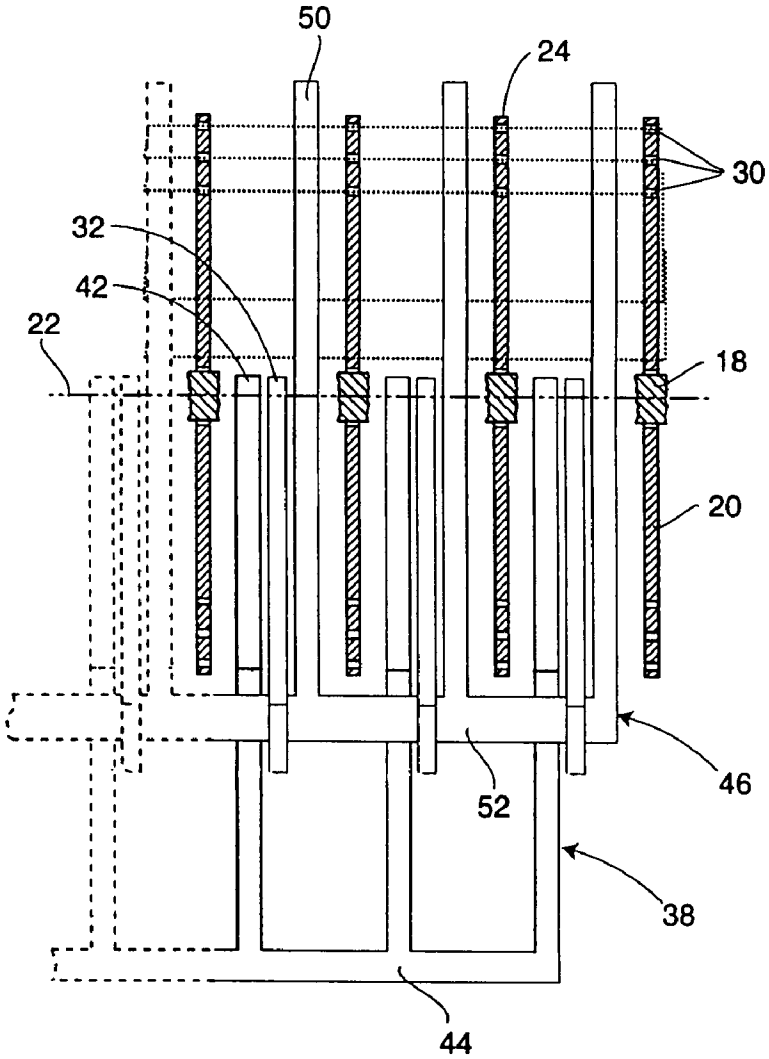
FIG. 3 is a view similar to FIG. 2, illustrating the second separator finger in the stacking position and the first separator finger in the starting position.
Figure 2:
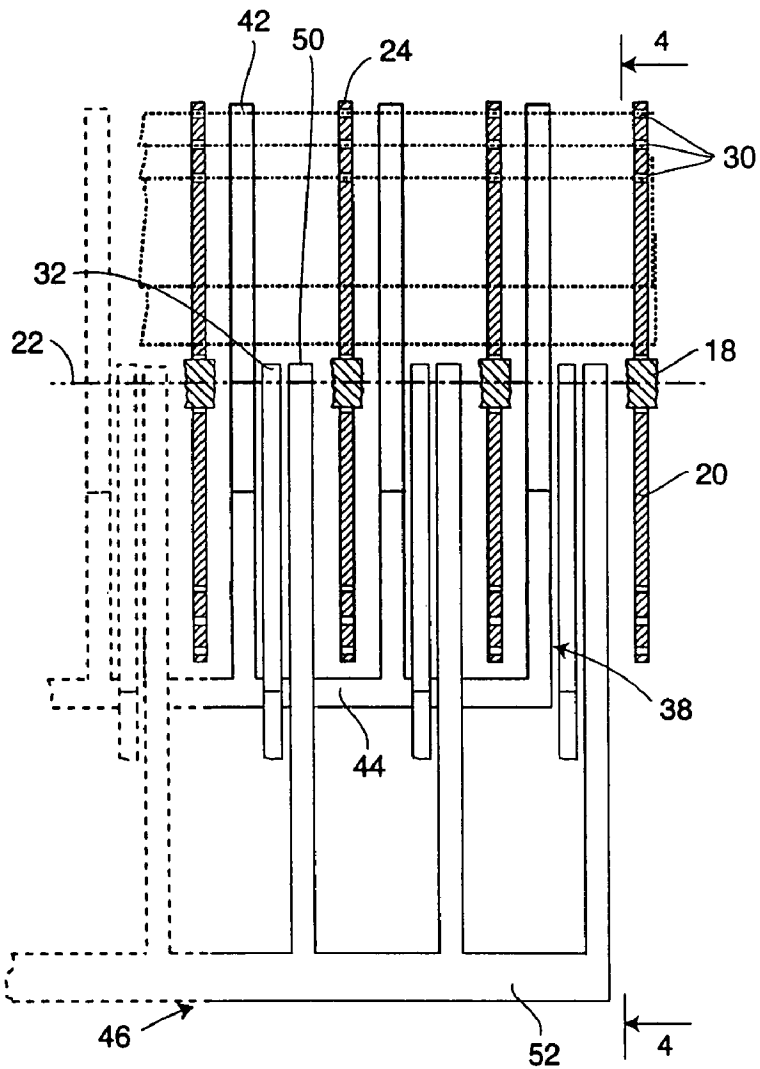
FIG. 2 is a top view taken along lines 2-2 of FIG. 1, illustrating a first separator finger in the stacking position and a second separator finger in the starting position.

Preferably, as viewed from FIGS. 2 and 3, the fingers 42 of the first separator finger 38, the fingers 50 of the second separator finger 46, and the barrier 32 are spaced apart laterally between adjacent starwheels 20. For example, the fingers 42 of the first separator finger 38 can be positioned on one side of each space between the starwheels 20, with the fingers 50 of the second separator finger 46 positioned on the other side of each space between the starwheels 20, and the barrier 32 positioned between the fingers 42, 50 of the first and second separator fingers 38, 46. In one highly preferred embodiment, the fingers 42, 50 of the first and second separator fingers 38, 46 are positioned on one side of each space between the starwheels 20, and the barrier 32 is positioned on the other side of each space between the starwheels 20. In some embodiments, those spaces of the starwheel assembly 14 nearest the ends of the starwheel assembly 14 have fingers 42, 50 located on the outboard side of the spaces for increased sheet support.

The relative order of the fingers 42, 50 and the barrier 32 can be varied between the adjacent starwheels 20. In addition, any combination or number of fingers 42, 50 and barriers 32 can be present within each space between adjacent starwheels 20. For example, for a starwheel assembly 14 consisting of a series of many starwheels 20, a finger 42 of the first separator finger 38 can be positioned between alternating adjacent starwheels 20 and the fingers 50 of the second separator finger 46 can be positioned between the remaining adjacent starwheels 20. Although any combination or variation of elements between adjacent starwheels 20 is within the scope of the present invention, it is preferred to position the fingers 42, 50 of a single separator finger 38, 46 close enough together so that the sheets can be supported on the separator finger 38 without any sag between the fingers 42, 50. In a similar fashion, it is preferred to have the barriers 32 spaced apart from each other along the length of the starwheel assembly 14 such that the sheets are evenly stripped from the starwheel assembly 14.

It should be noted that although the barrier 32 and the first and second separator fingers 38, 46 are described as separate elements, a barrier 32 can instead be connected directly to each of the separator fingers 38, 46. As an example, a separator finger 38 can include a barrier 32 that projects vertically from the finger 42 such that when the separator finger 38 is inserted through the starwheel assembly 14, the barrier 32 will strip the sheets from the starwheel assembly 14. The barrier 32 that is mounted to the separator finger 38 can be long enough to extend within the starwheel assembly 14 even as the separator finger 38 is moved radially away from the starwheel assembly axis 22 to accommodate additional sheets. In some embodiments employing such a barrier 32, sheets can be discharged from the finger 42, 50 by passing the fingers between a number of conveyors (e.g., belt conveyors, tabletop conveyors, and the like). Other manners of removing stacks from the fingers 42, 50 are possible and will be described in greater detail below.

The stacking apparatus 10 can include a conveyor 54 that receives the stack from the separator finger 38 and moves the stack away from the starwheel assembly axis 22. The conveyor 54 is preferably a conveyor belt that is configured to allow the separator finger 38 to deposit the stack onto the conveyor 54 and to retract from the conveyor 54 such that the stack remains supported by the conveyor 54. Preferably, this can be accomplished by a series of grooves within the belt that are located at the same distances apart as the fingers 42 on the separator finger 38. By way of this configuration, the separator finger 38 supports the stack until it is lowered into the recesses at which time the stack is transferred to the conveyor 54 which will then support the stack. The recesses can be formed integrally with the belt or can be voids in the conveyer 54, thereby separating the conveyor 54 into a plurality of smaller belts. The fingers 42 of the separator finger 38 can preferably pass through the gaps between the segmented conveyor 54 in order to transfer the stack from the separator finger 38 to the conveyor 54. The conveyor 54 need not be a conveyor belt, but instead can be anything that can move the stack away from the starwheel assembly axis 22 such as a bucket, plate, box, arm, or support that is movable by other methods of conveyance known to those skilled in the art.

The stack can be transferred onto the conveyor 54 from the separator finger 38 by mechanisms that work independently of the conveyor 54. In one highly preferred embodiment illustrated in the figures, the barrier 32 projects downward such that the barrier 32 will strip the stack from the separator finger 38 when the separator finger 38 retracts from the front of the barrier 32 to behind the barrier 32 allowing the stack to drop onto the conveyor 54. Alternatively, one or more movable projections can be employed to sweep across the fingers 42 to eject the stack onto the conveyor 54. In addition, a conventional mechanism such as robotic grips or fingers can be used to grab the stack from the separator finger 38 and move the stack onto the conveyor 54. Other manners of removing the stack from the fingers 42 are possible and would be recognized by one having ordinary skill in the art.

Figure 23:
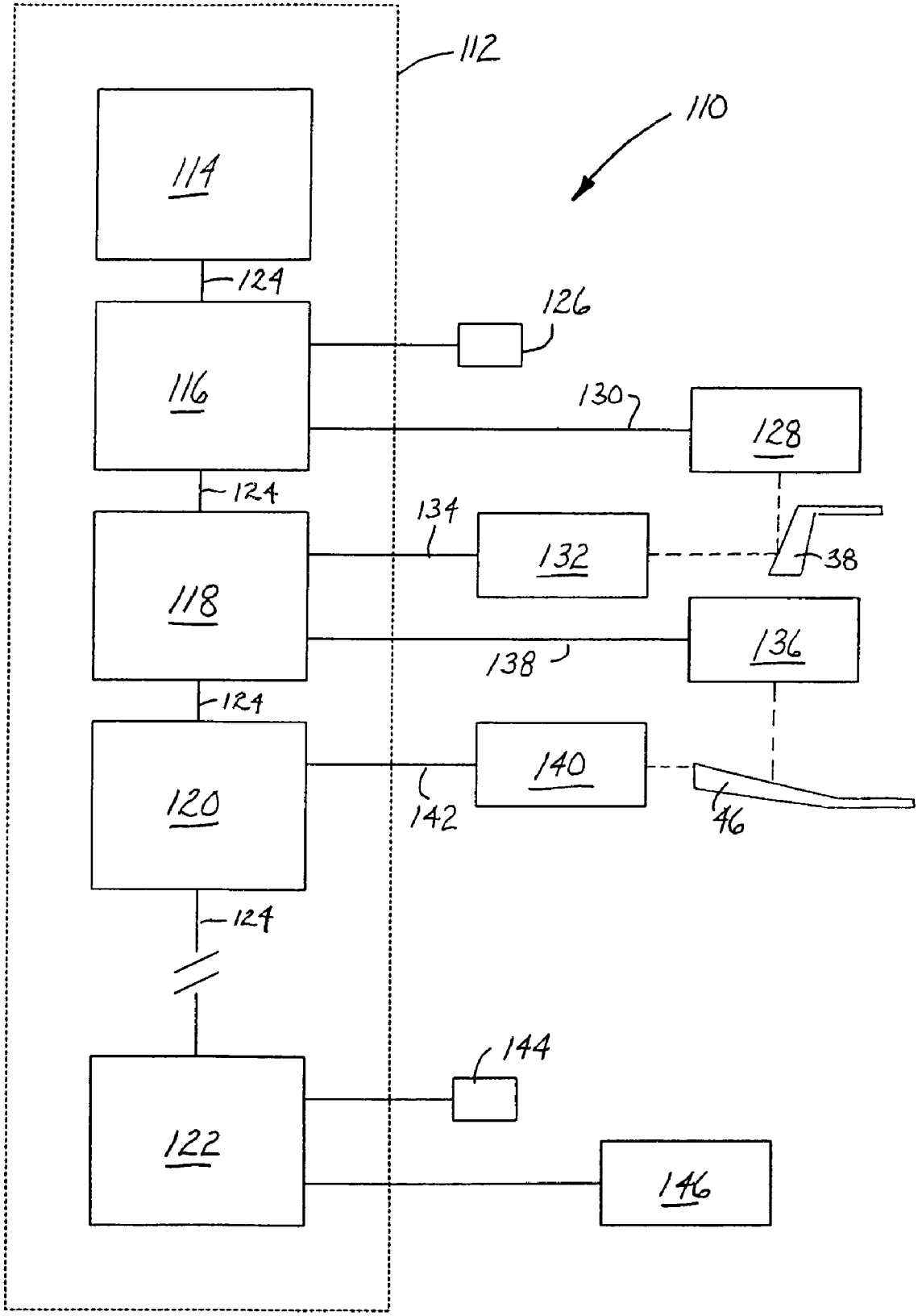
FIG. 23 is a schematic view of the control system of the stacking apparatus shown in FIG. 1.

FIG. 23 illustrates a control system for the apparatus 10, and particularly for controlling the movement of the separator fingers 38, 46. The control system 110 includes a controller 112. The controller 112 of one preferred embodiment is an ORION model controller produced by ORMEC Systems Corporation of Rochester, N.Y. providing centralized control of the apparatus 10. In another preferred embodiment (not shown) the controller is a ControlLogix model controller produced by Allen-Bradley Corporation of Milwaukee, Wis. Other commercially available or custom designed controllers can be easily substituted for these controllers and are considered as being within the scope of the invention such as, for example, various centralized and/or distributed control systems well-known to those skilled in the art.

In one preferred embodiment, the controller 112 includes a central processing unit 114 and a series of four axis cards 116, 118, 120, 122 connected to the central processing unit 114 via a communications bus 124. The control system 110 preferably includes an encoder 126 connected to the first axis card 116. The encoder 126 provides information to the controller 112 relating to the position of the starwheel 20. Preferably, the control system 110 also includes a vertical drive motor 128 for the first separator finger 38. The vertical drive motor 128 is preferably connected to the first axis card 116 through a data link 130 and electrical drive unit (not shown). Drive and control signals are transmitted from the controller 112 through the axis card 116 and the data link 130 to the vertical drive motor 128 to control operation of the motor 128, and through the motor 128, provide vertical motion control of the first separator finger 38. The vertical drive motor 128 is connected to the first separator finger 38 through an appropriate linkage (which is only shown schematically in FIG. 23).

The control system 110 also preferably includes a horizontal drive motor 132 for the first separator finger 38. The horizontal drive motor 132 is preferably connected to the second axis card 118 through a data link 134 and electrical drive unit (not shown). Drive and control signals are transmitted from the controller 112 through the second axis card 118 and the data link 134 to the horizontal drive motor 132 to control operation of the motor 132, and through the motor 132, provide horizontal motion control of the first separator finger 38. The horizontal drive motor 132 is connected to the first separator finger 38 through an appropriate linkage (which is only shown schematically in FIG. 23). As described in greater detail below with respect to the overall operation of the stacking apparatus 10, the horizontal and vertical drive motors 132, 128, in cooperation with the controller 112, preferably provide independent (i.e., asynchronous) vertical and horizontal control of the separator finger 38.

The control system 110 also preferably includes a vertical drive motor 136 connected to the second separator finger 46 through the second axis card 118 and the corresponding data link 138 and electrical drive unit (not shown), and a horizontal drive motor 140 connected to the second separator finger 46 through a third axis card 120 and corresponding data link 142 and electrical drive unit (not shown). The second horizontal and vertical drive motors 140, 136 preferably cooperate with the controller 112 to provide independent, (i.e., asynchronous) vertical and horizontal control of the second separator finger 46.

In some preferred embodiments such as that shown in the figures, the control system 110 also includes an encoder 144 connected to the fourth axis card 122 of the controller 112 and a motor 146 for a wrapper unit (not shown) connected to the fourth axis card 122. The encoder 144 and motor 146 receive signals from the controller 112 to coordinate the operation of the wrapper unit with the stacking apparatus 10. The motor 146 is preferably a belt drive motor, but provide driving power in any other manner (including without limitation by chain or cable drives, by suitable gearing, by direct or gearbox connection to the wrapper unit, and the like). Like the other motors 128, 132, 136, 140, the wrapper unit motor 146 can be any conventional type of driving unit, such as an electric motor, an engine, a hydraulic motor, and the like.

Although the above-described control system for the stacking apparatus 10 is most preferred, it should be noted that other control systems can be employed to perform the same vertical and horizontal finger positioning control functions. For example, PC-based control systems can be directly or indirectly connected to motors 128, 132, 136, 140 (or pneumatic or hydraulic valves in those embodiments employing pneumatic or hydraulic actuators to move the fingers 38, 46, solenoids in those embodiments employing electrical solenoids to move the fingers 38, 46, and the like). As another example, the motors 128, 132, 136, 140 can be digital drive motors each having a controller connected to a main controller. The main controller can provide driving instructions to one or more of the digital drives, which can in turn provide driving instructions to one or more of the other digital drives as desired. One having ordinary skill in the art will appreciate that still other types of control systems can be employed to drive the fingers 128, 136 as described herein, each one of which falls within the spirit and scope of the present invention.

Figure 24:
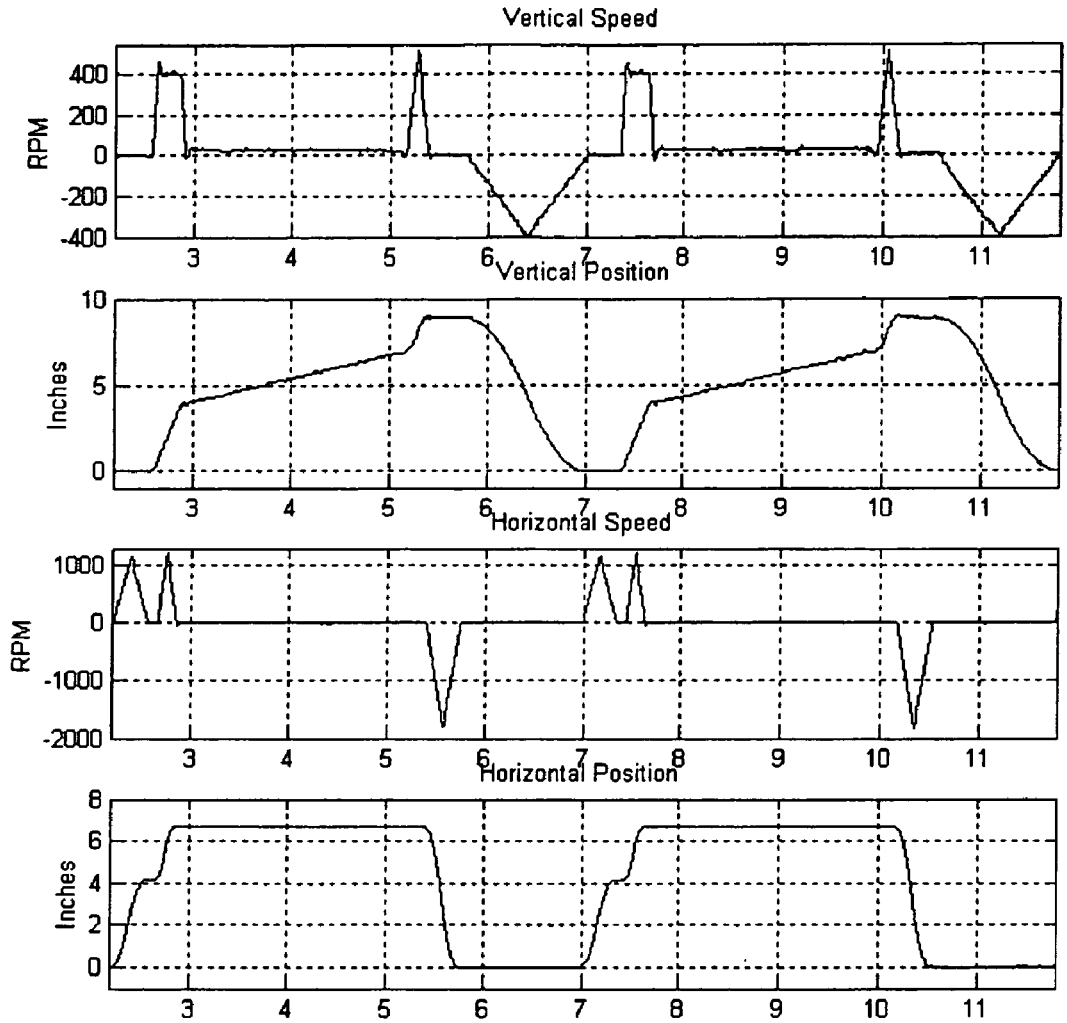
FIG. 24 graphically illustrates the speed and position of the separator finger.

The operation of a preferred embodiment of the stacking apparatus 10 is illustrated in FIGS. 4-11 and 24. FIGS. 4-11 illustrate the operation of the preferred embodiment as viewed from the side of the starwheel assembly 14 and FIG. 24 graphically illustrates the horizontal and vertical motion characteristics of the separator finger 38 as it moves through its cycle. Specifically, FIG. 24 illustrates the horizontal speed and horizontal position of the separator finger 38 and the independently controlled vertical speed and vertical position of the separator finger 38 for 2 cycles (i.e., 2 seconds through 7 seconds and 7 seconds through 12 seconds). It should be noted that the inches referred to in the "Vertical Position" graph of FIG. 24 are inches below a vertical starting position of the separator finger 38, while the inches referred to in the "Horizontal Position" graph of FIG. 24 are inches laterally beyond a horizontal starting position of the separator finger 38. The two cycles illustrated represent a highly preferred motion profile generating superior results for stack separation in the starwheel assembly 14. Although this profile is highly preferred, it should be noted that other motion profiles (e.g., different horizontal and vertical positions and paths, different horizontal and vertical speeds, etc.) can instead be used as desired.

Figure 4:
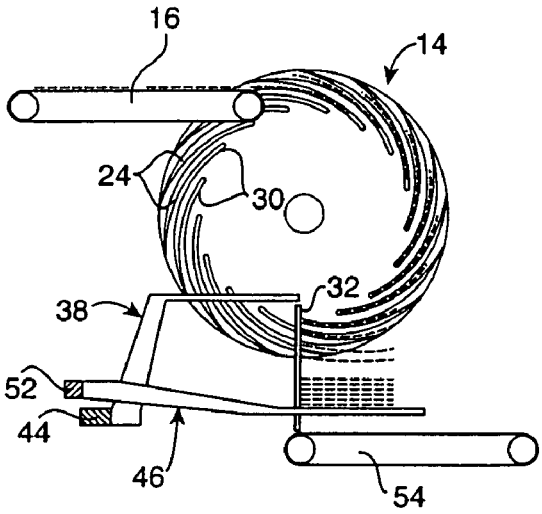
FIGS. 4-11 is a cross-section view taken along lines 4-4 of FIG. 2, illustrating the progressive motion of the first separator finger and the second separator finger.

FIG. 4 illustrates the first separator finger 38 positioned in a starting position with the starwheel assembly 14 continuously rotating in a clockwise direction (FIG. 24, at 2 seconds). The starting position is located within the starwheel assembly 14 and adjacent to the barrier 32 such that the finger 38 does not intersect the rotating slots 30. Although not required, the separator finger 38 in some embodiments is located entirely upstream of the barrier 32 in this starting position.

The feeding system 16 preferably inserts a sheet into each of the slots 30 on the starwheels 20. The sheets are preferably fed into the slots 30 by the feeding system 16 such that each sheet positioned against the crotch of the slot 30 between two adjacent fins 24. The feeding system 16 is timed with the rotation of the starwheel assembly 14 such that the sheets from the feeding system 16 are inserted into successive slots 30 on the starwheels 20 while both the feeding system 16 and the starwheel assembly 14 run at substantially constant speeds. It is, however, not necessary that every slot 30 on the starwheel assembly 14 be fed with a sheet. Rather, any number of slots 30 can remain empty between fed sheets within the starwheel assembly 14. In fact, as little as one sheet can be fed per rotation of the starwheel assembly 14.

The fins 24 support the sheet in the slots 30 as the starwheel assembly 14 rotates. The sheets preferably slide into the slots 30 until they contact the bottom of the slots 30. The sheets then rotate with the starwheel assembly 14 until the radially inward ends of the sheets contact the barrier 32 at a contact point 58 on the barrier 32. The barrier 32 causes the sheet to be stripped from the slot 30 of the starwheel 20. The contact point 58 between the barrier 32 and the sheet moves downward away from the axis 22 of the starwheel assembly 14 as the starwheel assembly 14 rotates until the entire sheet is pushed out of its respective slot 30. It should be noted that the barrier 32 does not move the sheet out of the slot 30, but instead holds the sheet stationary as the starwheel assembly 14 continues to rotate, thereby stripping the sheet from the starwheel assembly 14. After the sheet is stripped from the starwheel assembly 14 by the barrier 32, the sheet is free to fall under the weight of gravity to begin, continue, or complete a stack of sheets. In other embodiments where the apparatus is oriented in different manners, the sheets can be stacked radially in other directions without the assistance of gravity.

Figure 5:
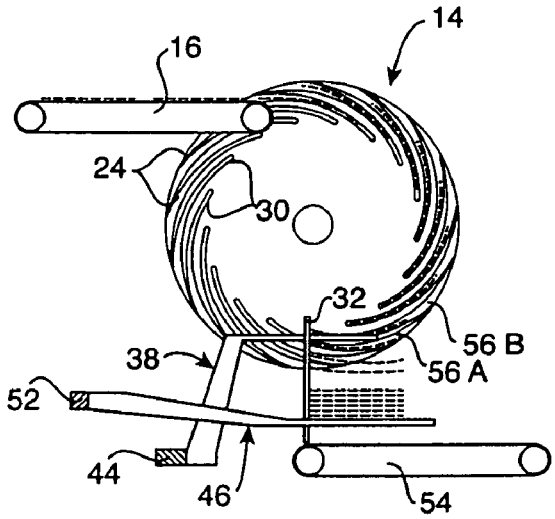
Figure 6:
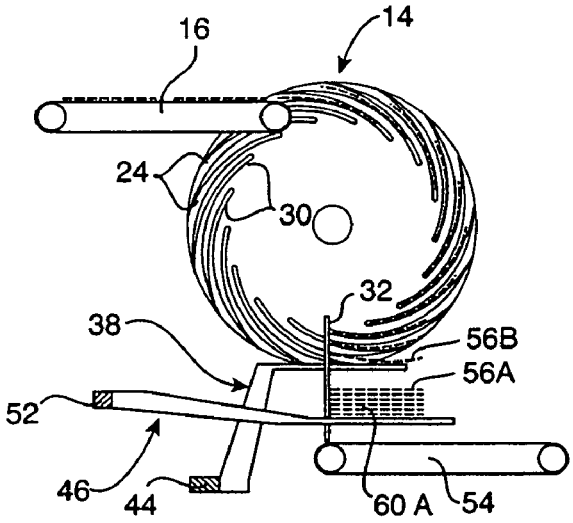
Figure 7:
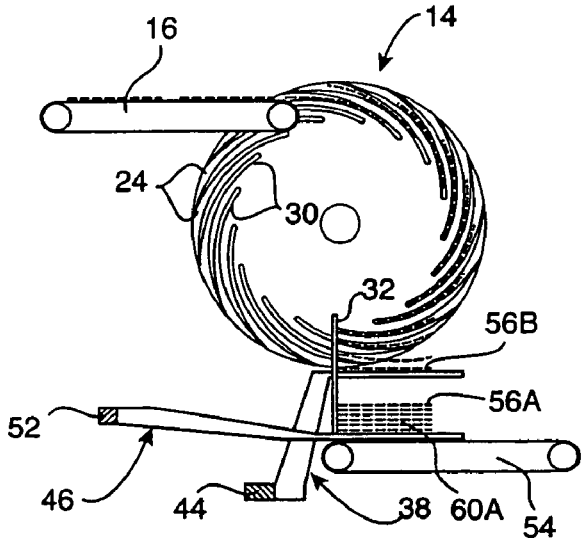
Figure 8:
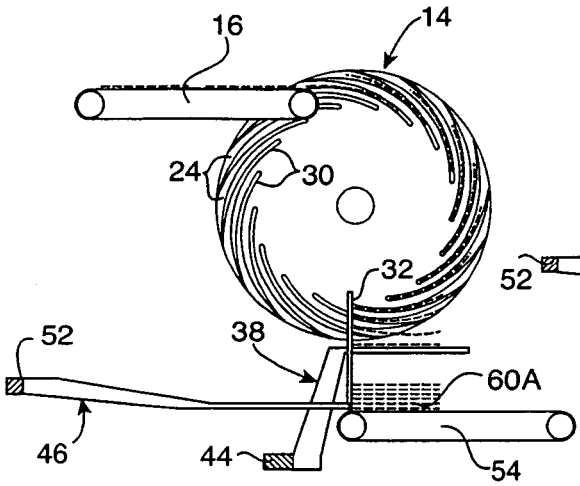
Figure 9:
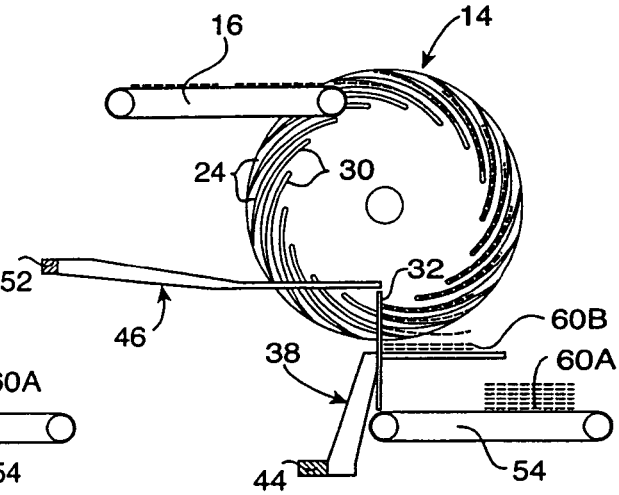
Figure 10:
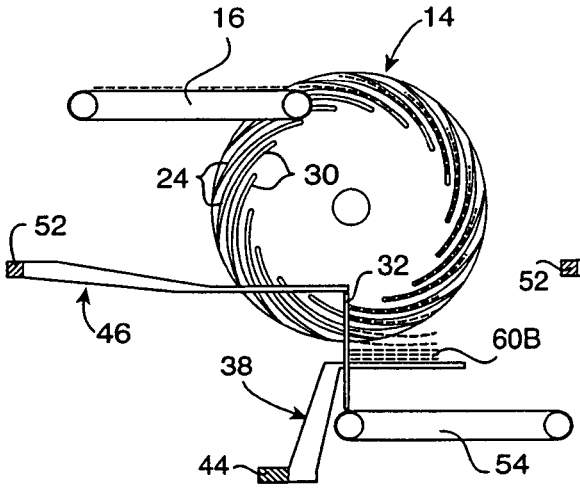

Referring to the FIGS. 5-7, enlarged detailed FIGS. 19-22, and FIG. 24, the first separator finger 38 is inserted between two adjacent sheets located within the rotating starwheel assembly 14 to separate a last sheet of a stack from the first sheet of a new stack (FIG. 24, beginning at 2.5 seconds). Once inserted between the slots 30, the separator finger 38 preferably moves against the direction of rotation and downward until the separator finger 38 is outside the starwheel assembly 14 and in a position to support a discharged sheet (FIG. 24, at 3 seconds). The separator finger 38 preferably moves from a position that is upstream of the barrier 32.

With combined reference to FIGS. 4-7, it should be noted that the starting position of the separator finger 38 illustrated in FIG. 4 is shown by way of example only, and that other starting positions of the separator finger are possible. As another example, the separator finger 38 can be located at a greater radial distance from the starwheel axis, such as a location directly behind (downstream) of the barrier 32. In such an embodiment, the separator finger 38 can be moved horizontally or at an angle through the barrier 32 and between two adjacent sheets located within the rotating starwheel assembly 14 in a manner similar to that described above.

The separator finger 38 can be translated, rotated, or can have any combination of such movement through a linear and/or curved path. Although the paths taken by the individual fingers of the separator finger 38 preferably lie substantially or entirely within respective planes, all or part of each finger can move out of such a plane if desired. In any case, the separator finger 38 preferably follows a path of motion through the starwheel assembly 14 between adjacent slots 30 in the starwheels 20. The two adjacent slots 30 include a downstream slot 30A located ahead of the separator finger 38 in the direction of rotation and an upstream slot 30B behind the separator finger 38 in the direction of rotation of the starwheel assembly 14.

Figure 19:
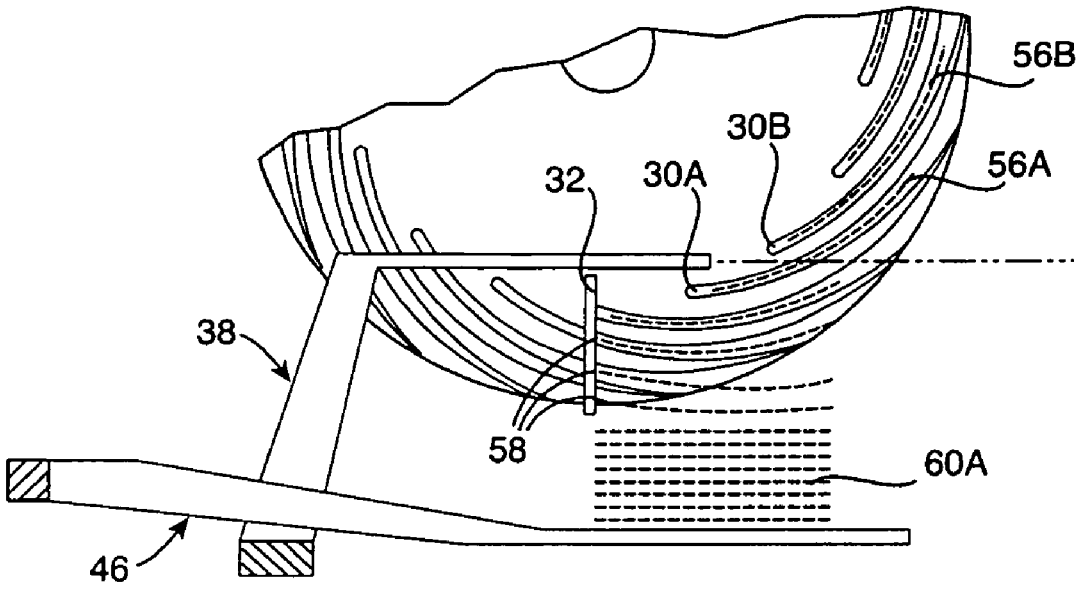
FIGS. 19-22 is an enlarged cross-section view similar to FIG. 4, illustrating the movement of a separator finger being inserted between adjacent sheets within the starwheel assembly.
Figure 20:
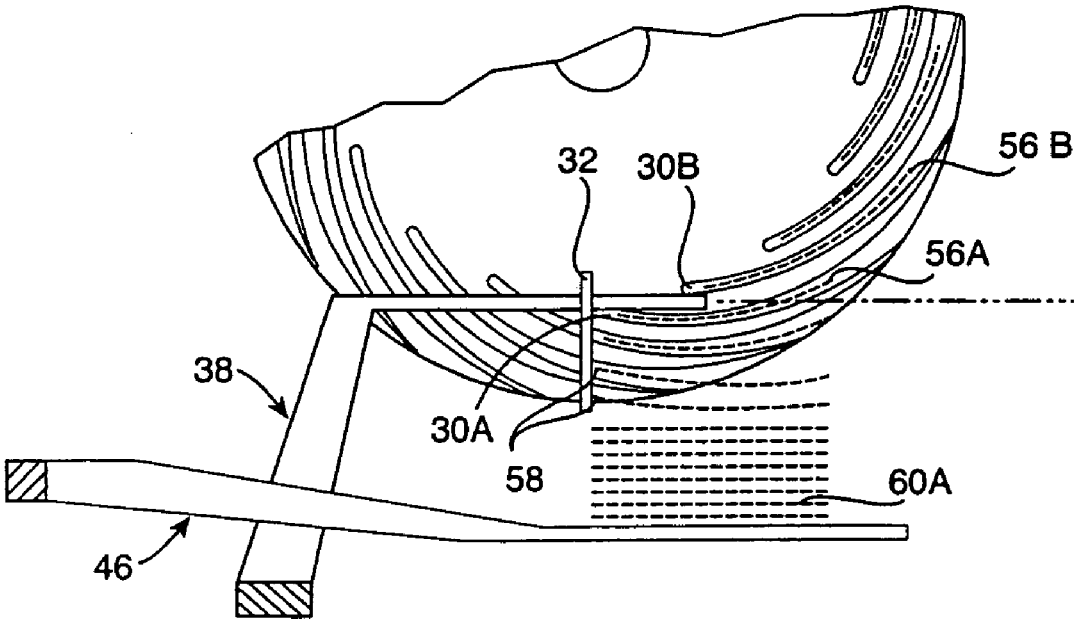
Figure 21:
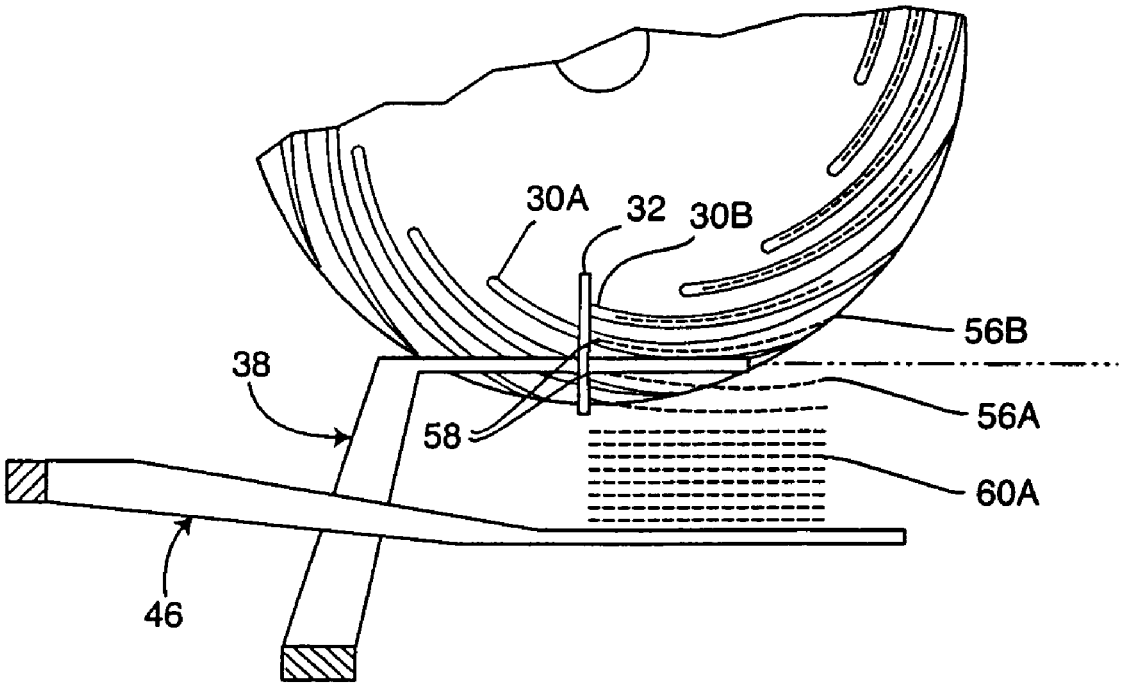
Figure 22:
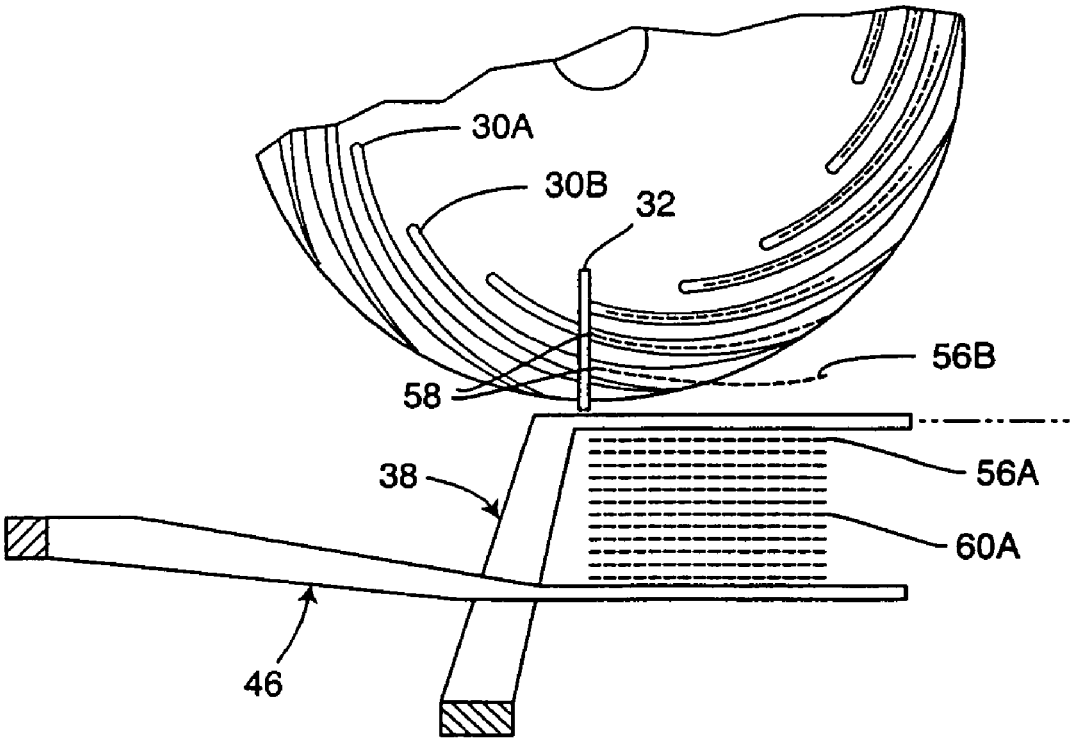

The path of motion of the separator finger 38 is important so as not to interfere with the sheets that are rotating within the starwheel assembly 14. In particular, the separator finger 38 preferably moves in accordance with the following procedure: (i) the tip 28 of the separator finger 38 is inserted between the adjacent slots 30 against the direction of rotation of the starwheel assembly 14 (FIGS. 19 and 20); (ii) the tip 28 of the slot 30 remains between the two adjacent slots 30 as the separator finger 38 continues to move until the separator finger 38 is outside of the starwheel assembly 14 (FIGS. 21 and 22); (iii) once inserted between the adjacent slots 30, the top surface of the separator finger 38 remains lower than the lowest point of the upstream slot 30; and (iv) the bottom surface of the separator finger 38 remains above the uppermost point of the downstream slot 30 that is located to the right of the barrier 32. The movement of the separator finger 38 is dependent upon the rotational speed of the starwheel assembly 14 and is timed to prevent interference with the sheets within the slots 30.

As illustrated in FIGS. 19-22, the first separator finger 38 is inserted between the downstream slot 30A and the upstream slot 30B and as a result between sheet 56A and sheet 56B respectively. The starwheel assembly 14 continues to rotate and the first separator finger 38 continues to move through the starwheel assembly 14 as described above. The barrier 32 will force the sheet 56A out of the downstream slot 30A such that the sheet 56A will fall and complete the stack 56A below. The insertion of the first separator finger 38 is preferably programmed such that the sheet 56A will be the last sheet of a desired stack size (e.g., the $100^{th}$ sheet of a 100 count stack). The separator finger 38 continues to move completely out of the starwheel assembly 14 into a stacking position where the separator finger 38 preferably supports the sheet 56B which has been discharged from the upstream slot 30B by the barrier 32. The sheet 56B is the first sheet of a new stack 60B that will begin to be built upon the first separator finger 38 (e.g., the $1^{st}$ sheet of a new stack of 100 sheets).

With reference to FIGS. 8-11, additional discharged sheets fall to the stack 60B on the first separator finger 38. Preferably, the separator finger 38 gradually moves radially away from the axis 22 of rotation to provide adequate clearance from the starwheel assembly 14 for the additional sheets (FIG. 24, between 3 seconds and 5 seconds). The additionally stacked sheets therefore preferably fall onto the partially completed stack 60B the same distance from the starwheel assembly 14 as a result of the first separator finger 38 moving radially away from the axis 22 and the stack increasing. In other embodiments, the separator finger 38 instead moves to a position permitting additional sheets to be stacked thereon without gradual movement of the separator finger 38 away from the axis 22 of rotation. Accordingly, a separator finger that is held stationary to support additional sheets after it moves through the starwheel assembly is within the scope of the present invention.

Figure 11:
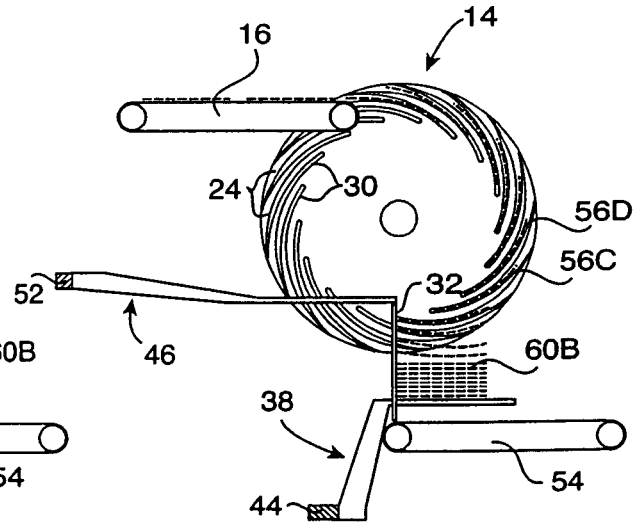

The operation of the second separator finger 46 will now be discussed in detail, but will not be shown specifically in the drawings as the second separator finger 46 preferably progresses through similar movement as the first separator finger 42 described above and shown in FIGS. 4-11. The second separator finger 42 will preferably follow the movements and accelerations of the first separator finger 38 shown in FIG. 24, except that the second separator finger will be 180 degrees out of phase (i.e., offset by 3.5 seconds for the illustrated embodiment). The second separator finger 46 is moved to the starting position as the additional sheets are being stacked on the stack 60B that is supported by the first separator finger 38. The second separator finger 46 is inserted between two adjacent slots 30 such that the downstream slot 30C possesses the sheet 56C that will complete the stack 60B on the first separator finger 38 (e.g., the $100^{th}$ sheet) and the upstream slot 30D possesses the first sheet 56D of a new stack (e.g., the $1^{st}$ sheet) (FIG. 11). The second separator finger 46 moves through the starwheel assembly 14 to the stacking position. The second separator finger 46 allows the sheet 56C to fall and complete the stack 60B supported by the first separator finger 38 and supports the sheet 56D that is stripped from the starwheel assembly 14 by the barrier 32. The second separator finger 46 moves radially away from the starwheel assembly axis 22 to provide additional space to accommodate additional discharged sheets on the stack.

After the second separator finger 46 interrupts stacking of discharged sheets onto the first separator finger 38, the first separator finger 38 preferably moves toward the conveyor 54. The stack 60B is then transferred to the conveyor 54, after or during which time the first separator finger 38 moves away from the conveyor 54 (FIG. 24, between 5.5 and 6 seconds). The stack 60B can be transferred to the conveyor 54 in any of the manners described above. In the illustrated preferred embodiment for example, the stack 60B is transferred by drawing the first separator finger 38 through the barrier 32. The first separator finger 38 then preferably returns to the starting position to repeat the cycle when the downstream slot of two adjacent slots 30 includes the last sheet that will complete the stack on the second separator finger 46 (FIG. 24, between 6 seconds and 7 seconds). The conveyor 54 moves the stack 60B away from the starwheel assembly axis 22 to create room for the next stack to be placed on the conveyor 54 by the second separator finger 46.

In the embodiment shown in FIGS. 4-11, the first separator finger 38 and the second separator finger 46 work in succession to stack discharged sheets from the starwheel assembly 14 and transfer the stack of a preferably predetermined number to a conveyor 54 without interrupting the rotation of the starwheel assembly 14. The first and second separator fingers 38, 46 repeatedly progress through the same motions separated by a period of time that is determined by the time needed to reach a desired stacking height. For example, when the desired stack size is small, the separator fingers 38, 46 can be in constant motion such that the separator fingers 38, 46 move directly through the starting position and between two adjacent sheets without pausing. Alternatively, if the stack height is a large number, each separator finger 38, 46 can pause in the starting position until the last sheet that completes a partially completed stack needs to be separated from a new sheet that begins a new stack on the inserted separator finger.

In an alternative embodiment, the second separator finger 46 preferably operates to receive partially completed stacks from the first separator finger 38. During operation of this embodiment, the first separator finger 38 preferably transfers the partially completed stack to the second separator finger 46 and then returns to the starting position. The second separator finger 46 preferably moves radially away from the starwheel axis 22 in order to accumulate additional sheets on the partially completed stack. Once the desired number of sheets have been stacked on the second separator finger 46, the first separator finger 38 is re-inserted between two adjacent slots 30 such that the downstream slot 30 possesses the sheet that will complete the stack on the second separator finger 46. The first separator finger 38 then preferably begins moving radially away from the starwheel axis 22 to accumulate additional sheets while the second separator finger 46 moves to transfer the completed stack onto the conveyor 54. After the stack is transferred, the conveyor 54 preferably moves the stack away from the starwheel assembly 14 and the second separator finger 46 moves toward the starwheel axis 22 to again receive the partially completed stack from the first separator finger 38.

It should be noted that at extremely high speeds (i.e., above 80% of the maximum rated speed for the illustrated embodiment), the fingers 42, 50 on the separator fingers 38, 46 can experience slight deformations and amplified vibrations due to high acceleration and deceleration forces. To reduce such effects, the fingers 42, 50 on the separator fingers 38, 46 can include constrained layers of damping material. In one preferred embodiment, the separator fingers 38, 46 have a relatively lightweight, high strength layer of composite damping material (sandwiched between layers of substantially resilient material defining the majority of the separator fingers 38, 46) to dampen the vibrations caused by operation at such high speeds. By way of example only, the separator fingers are made at least partially of steel, and each have a 0.002" thick layer of viscoelastic damping material (e.g., ISD 112 viscoelastic polymer manufactured by 3M®) sandwiched between the finger and a 0.015" thick constraining layer of steel. One having ordinary skill in the art will appreciate that still other constrained layer damper materials and constructions are possible, each falling within the spirit and scope of the present invention.

In an alternative embodiment shown in FIGS. 12-18, the stacking apparatus 10 includes a single separator finger 38 and a movable conveyor 62. The separator finger 38 and the movable conveyor 62 work in succession to consistently stack discharged sheets from the starwheel assembly 14 and move the stack on the movable conveyor 62 away from the starwheel assembly axis 22, without interrupting the rotation of the starwheel assembly 14. The movable conveyor 62 moves towards the starwheel assembly axis 22 to receive the stack from the separator finger 38 and away from the starwheel assembly axis 22 to accumulate additional sheets that are discharged from the starwheel assembly 14. The movable conveyor 62 includes a first conveyor belt 64 that is rotatably coupled to a second conveyor belt 66, but can take any form of conveyor as described above with reference to conveyor belt 54, including a single conveyor belt translatable and/or rotatable with respect to the starwheels 20. In each alternative case, the conveyor 62 is preferably movable toward and away from the starwheel assembly axis 22. The second conveyor belt 66 is preferably pivotally coupled to the frame such that the first conveyor belt 64 is movable by the second conveyor belt 66. It is not necessary that the movable conveyor 62 be a series of conveyor belts (as discussed above, the movable conveyor 62 can take other forms).

Although a movable conveyor 62 is highly preferred to enable the stack to be transferred from the separator finger 38 to the movable belt 62 without significant disturbance, the conveyor 62 need not necessarily move in some embodiments. For example, for relatively short count stacks, the conveyor 62 can be located closer to the starwheel assembly 14 and need not move (or even be movable) toward and away from the starwheel assembly 14.

Figure 12:
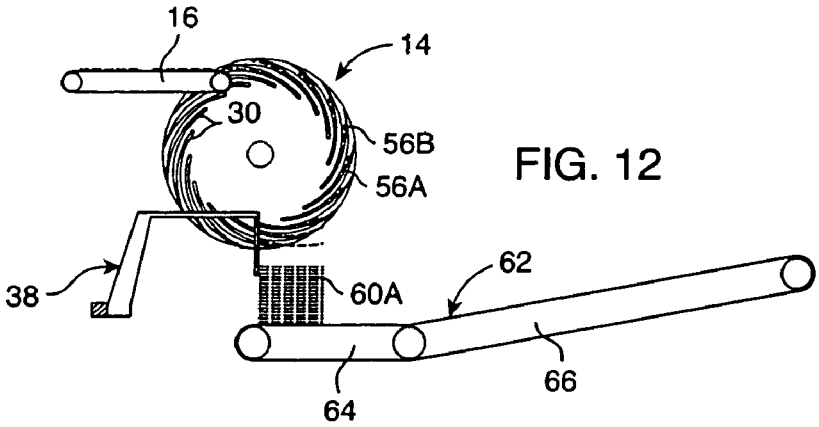
FIGS. 12-18 is a cross-section view of an apparatus according to a second preferred embodiment of the present invention, illustrating the progressive motion of a first separator finger and a movable conveyor.
Figure 13:
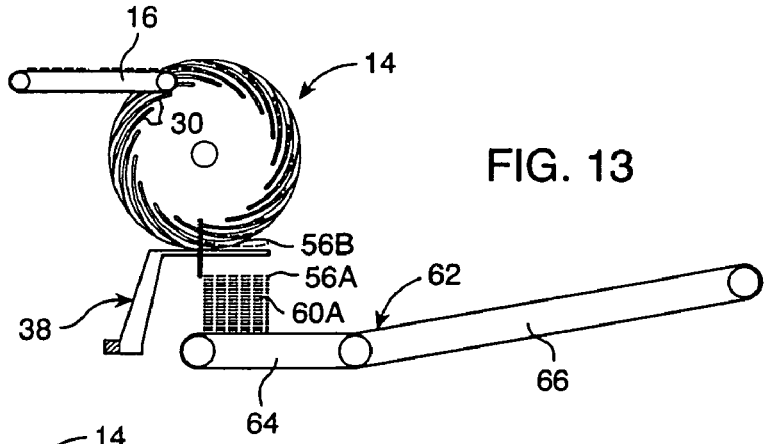

The operation of this embodiment of the stacking apparatus 10 is illustrated in FIGS. 12-18. During operation of this embodiment, the separator finger 38 begins in the starting position as shown in FIG. 12 and is inserted between two adjacent slots 30 in a similar manner as described above. After the separator finger 38 is moved outside of the starwheel assembly 14 (FIG. 13), the separator finger 38 supports the first sheet 56B and preferably moves radially away from the starwheel assembly axis 22 to accept additional discharged sheets (FIGS. 13-16).

Figure 17:
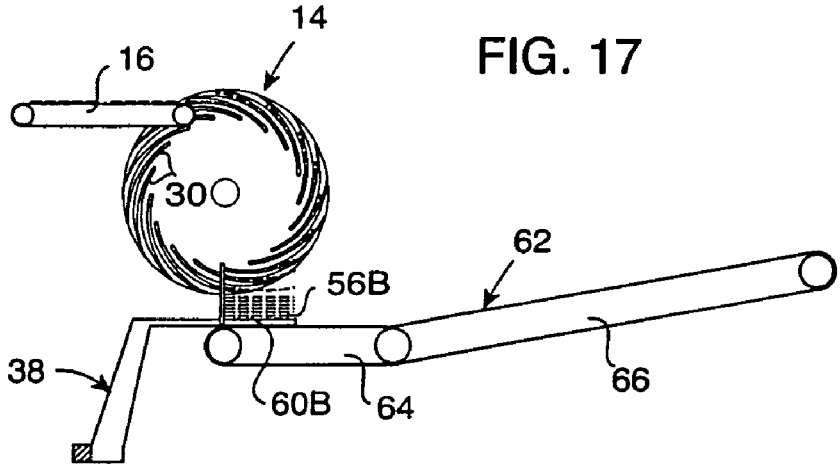
Figure 18:
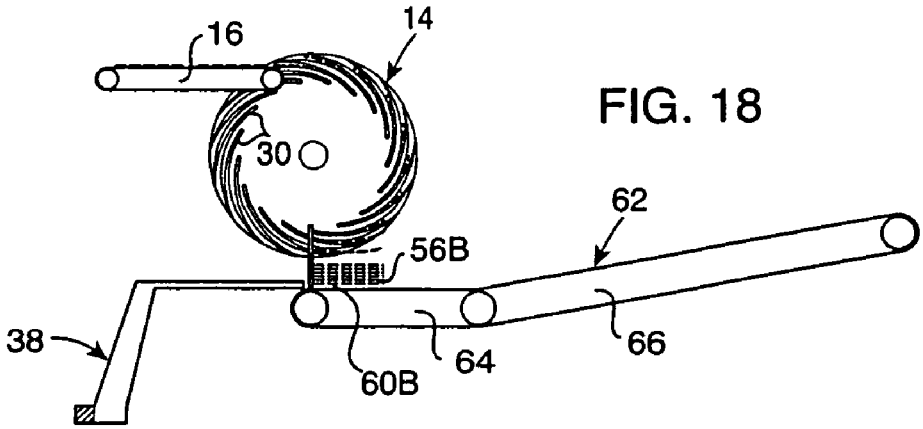

Referring to FIG. 17, the movable conveyor 62 moves toward the starwheel assembly axis 22 to receive the stack B from the separator finger 38. As shown in FIG. 18, the separator finger 38 retracts from the movable conveyor 62 to transfer the partially completed stack 60B on the movable conveyor 62. The movable conveyor 62 preferably moves radially away from the starwheel assembly axis 22 to provide additional clearance to accommodate additional discharged sheets. In such embodiments, the discharged sheets will preferably fall approximately the same distance to the top of the partially completed stack as the movable conveyor 62 moves away from the starwheel assembly axis 22 and the stack 60B size increases. In similar fashion to that shown in FIGS. 12-13, the separator finger 38 moves back into the starting position and is inserted between two adjacent slots 30 such that the downstream slot 30 possesses the sheet 56 that will complete the stack 60 on the movable conveyor 62.

Figure 14:
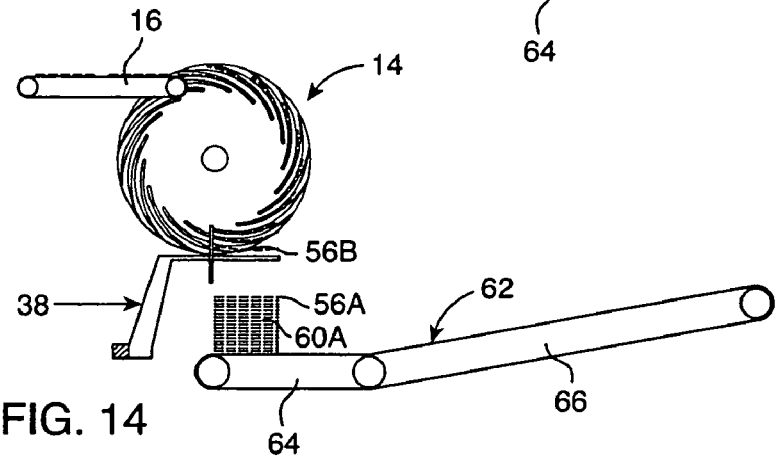
Figure 15:
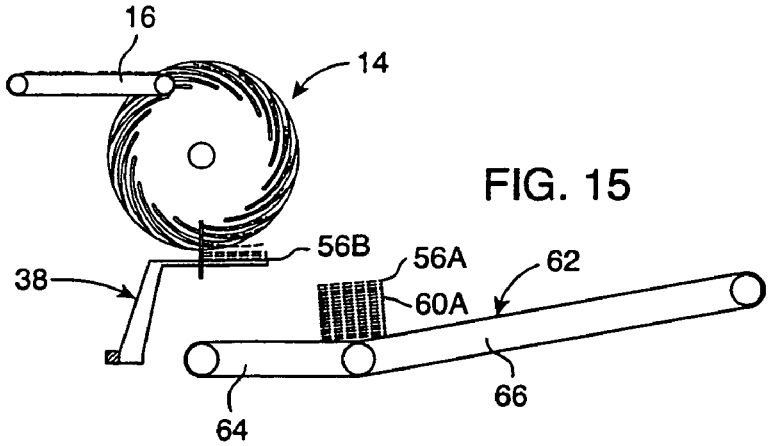
Figure 16:
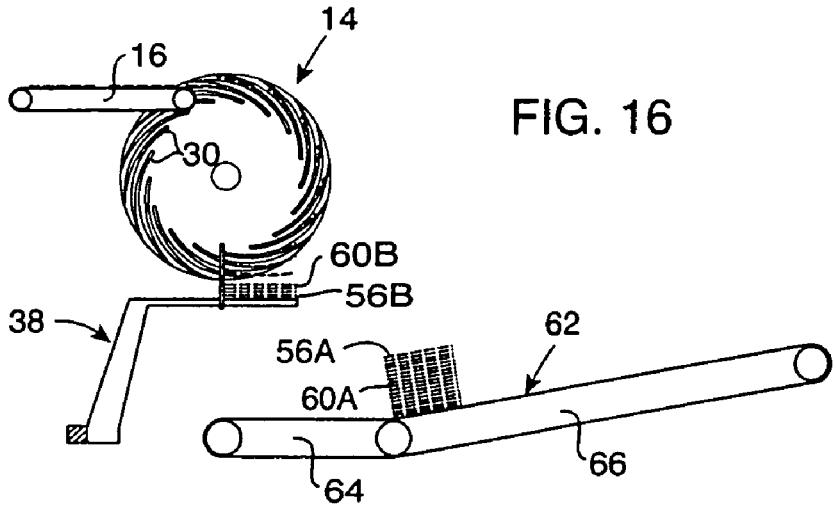

Similar to FIG. 14, once the stack 60 on the movable conveyor 62 is completed by the last sheet 56 and the separator finger 38 begins building a new stack 60, the movable conveyor 62 moves the stack 60 away from the starwheel assembly axis 22. After the stack 60 is moved away (e.g., FIGS. 15 and 16), the movable conveyor 62 can be moved toward the starwheel assembly axis 22 to again receive the partially completed stack 60 from the separator finger 38 (e.g., FIGS. 17 and 18).

It is possible for the movable conveyor 62 to start moving toward the starwheel assembly axis 22 while the movable conveyor 62 is moving a stack away from the starwheel assembly axis 22. This dual motion can be necessary when the stack heights are so small that there is minimal time between when the stack is completed on the movable conveyor 62 and when the movable conveyor 62 must receive the new partially completed stack from the separator finger 38. Alternatively, pausing between such motions of the movable conveyor 62 is possible when the stack height is sufficiently large to extend the cycle time of the stacking apparatus 10.

An important advantage provided by the separator fingers 38, 46 of the present invention results from the use of vertical and horizontal actuators (e.g., vertical and horizontal drive motors 128, 132, 136, 140) to control movement of the separation fingers 38, 46. Conventional separator elements and devices are constrained to move in a set manner. For example, some conventional separator elements can only move through a fixed path, such as a path determined by the path of a chain conveyor or a rotational path determined by the axis about which a separator finger rotates. The user is therefore either unable to change the manner in which the separator element or device moves or can only do so by shutting down the machine, disassembling a significant part of the machine, starting the machine, testing the machine's operation as adjusted, and repeating these steps until acceptable separator operation is achieved. In those cases where different types of product are often stacked and separated, this procedure is burdensome and time consuming.

In contrast, the separator fingers 38, 46 in some preferred embodiments of the present invention are independently controllable in horizontal and vertical directions as described above. With such control, the separator fingers 38, 46 can preferably be moved through any path limited by the range of actuation of the vertical and horizontal separator finger actuators. As described above, the vertical and horizontal drive motors 128, 132, 136, 140 of the separator fingers 38, 46 are preferably controlled by a controller 112 of a control system 110. This control system 110 is preferably operable by a user to change the manner in which the vertical and horizontal drive motors 128, 132, 136, 140 operate and therefore to change the path and movement of the separator fingers 38, 46.

Preferably, the separator fingers 38, 46 of the present invention are movable through a range of positions in a plane (and more preferably, through an infinite range of positions in the plane), and can be controlled to move through different paths in the plane as desired by a user. The separator fingers 38, 40 are therefore mechanically unconstrained to move in the plane and can be constrained by control of the vertical and horizontal actuators to move through any one of a number of desired paths based upon the operation of the starwheel assembly 14 and the type of product being run. Because separator finger motion can be changed by changing the actuation time and speed of the horizontal and vertical actuators driving the separator fingers 38, 46, the motion of the separator fingers 38, 46 can be quickly and easily adjusted by changing the associated program for each separator finger 38, 46, and in some embodiments can be automatically adjusted according to preprogrammed settings of the controller 112. In some preferred embodiments, the programs that control the motion of the separator fingers 38, 46 can even be changed during operation of the starwheel assembly 14.

By employing separator fingers 38, 46 that are movable in any selected path in a range of motion as described above, the stacking apparatus 10 of the present invention is capable of producing a large number of different package sizes and types with little or no machine downtime or changeover. For example, in some embodiments, the fingers 38, 46 can be controlled to produce stacks of product in any number desired from a 16-count stack to a 100 count stack. Different ranges of product counts are possible depending at least partially upon system speed. Such control is enabled by control over the starwheel assembly speed and/or the path and speed of the separator fingers 38, 46 driven by the drive motors 128, 132, 136, 140. In some highly preferred embodiments, the product count per stack can be quickly changed under control of the controller, such as by user selection of a preprogrammed setting, program, or other set of commands for the controller to follow.

In some highly preferred embodiments of the present invention, two separator fingers 38, 46 are each driven independently by actuators in a manner as described above. Independent control over multiple separator fingers 38, 46 enables relatively complex movement of the separator fingers 38, 46 relative to one another and relative to stacks of product being built. For example, where two separator fingers 38, 46 operate as described above with reference to FIGS. 4-11 and 19-22, one finger 38, 46 can be moved to be inserted between sheets of product 56A, 56B in the starwheel(s) 20 while another of the fingers 46, 38 moves in a significantly different manner to permit additional sheets of product to be stacked thereupon. Independent movement and control of the two separation fingers 46, 38 as described above enables such movement.

Figure 25:
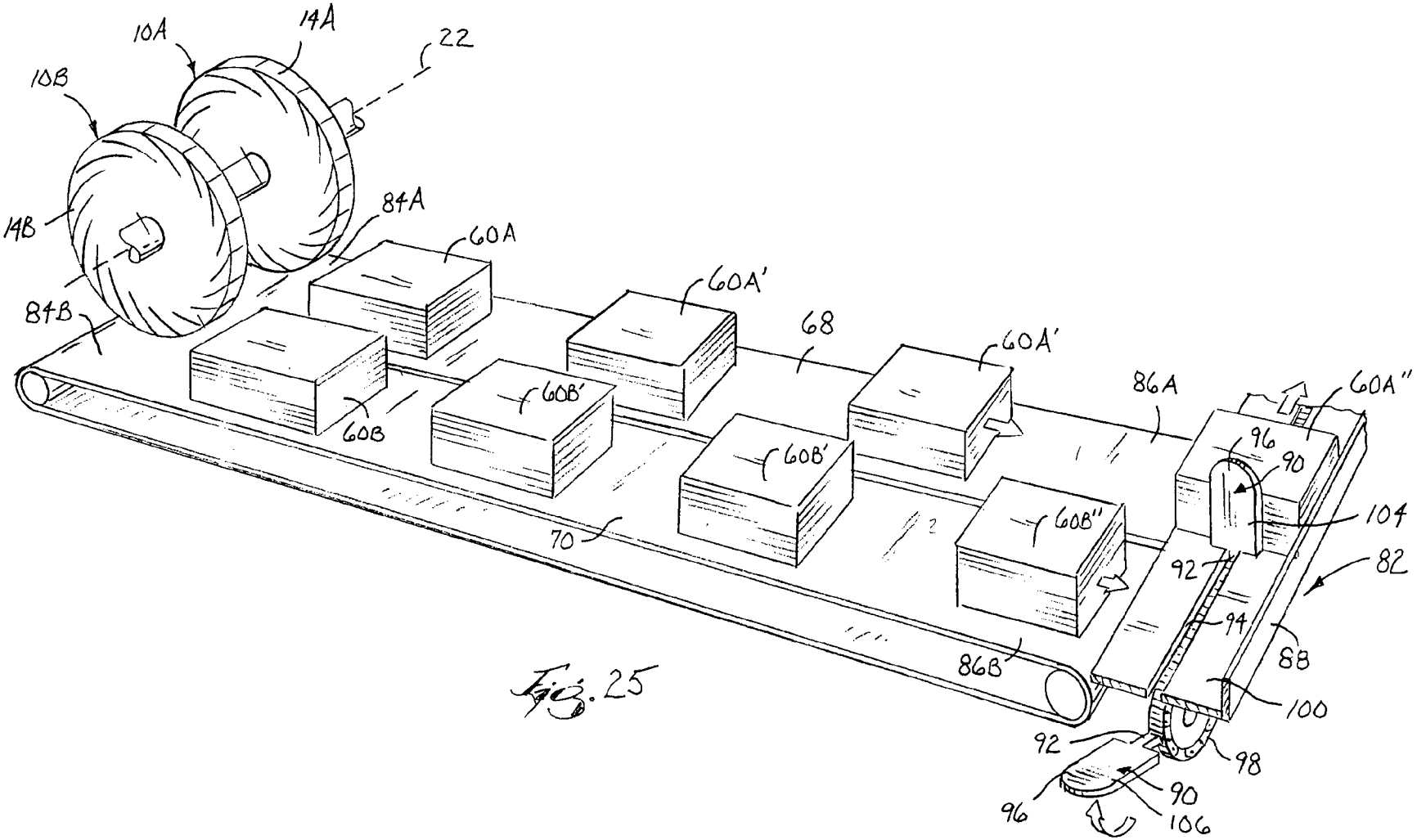
FIG. 25 is a perspective view of a conveyor system according to a preferred embodiment of the present invention.

Another embodiment of the present invention is illustrated in FIG. 25 and is preferably capable of producing multiple stacks of product from multiple starwheels 20 rotating about a common starwheel axis 22. Only two starwheels 20 are shown in FIG. 25 for the sake of simplicity. The stacks of product are preferably aligned or substantially aligned along the starwheel assembly 14 in the same or similar manner as described above with regard to the preferred embodiments illustrated in FIGS. 1-24. However, such aligned stacks of product can be produced in any other manner desired from any other upstream equipment. In the case of the starwheel assemblies 14, the stacks of product can be transferred to the conveyors in any of the manners described above with regard to the starwheel assemblies illustrated in FIGS. 1-24.

Figure 26:
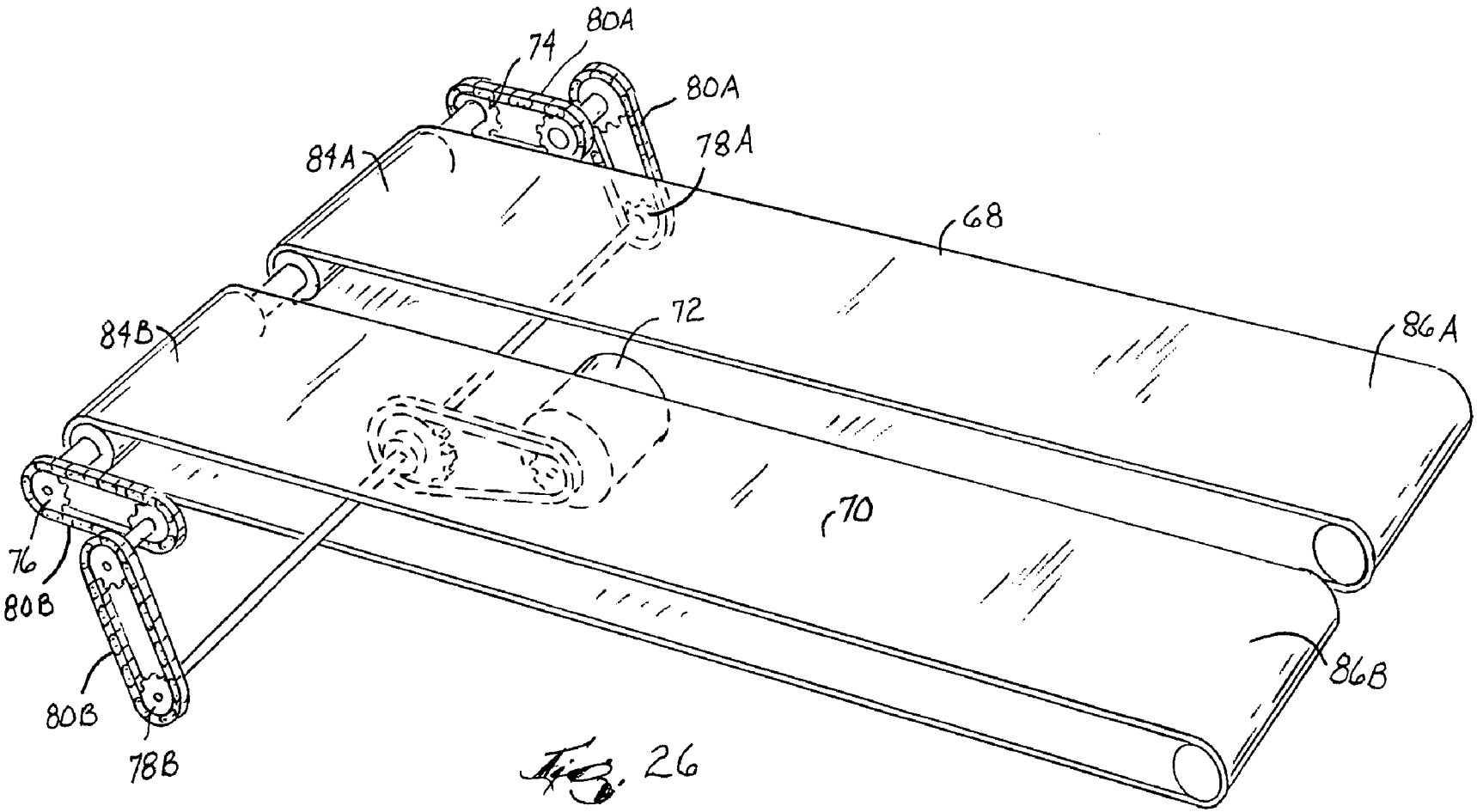
FIG. 26 is an enlarged perspective view of a first and second conveyor used in the preferred embodiment shown in FIG. 25.

As shown in FIGS. 25 and 26, this embodiment preferably includes a first conveyor 68 and a second conveyor 70. The first conveyor 68 is aligned with a first starwheel assembly 14A and the second conveyor 70 is aligned with a second starwheel assembly 14B such that the first conveyor 68 receives completed stacks from the first stacking apparatus 10A and the second conveyor 70 receives completed stacks from the second stacking apparatus 10B. For purposes of description and illustration, each stacking apparatus 10A, 10B and each starwheel assembly 14A, 14B preferably includes the same elements described above with regard to the starwheel assembly embodiments illustrated in FIGS. 1-24, and share a common pivot about which the starwheels 20 rotate. Each stacking apparatus 10A, 10B and starwheel assembly 14A, 14B can have any number of starwheels 20 as described in greater detail above (only one is shown in FIG. 25 for each stacking apparatus 10A, 100B and starwheel assembly 14A, 14B).

As mentioned earlier, the conveyors 68, 70 preferably receive the stacks from the stacking apparatuses 10A, 10B by any of the methods described above with respect to the other embodiments. The first conveyor 68 moves at a first speed and the second conveyor 70 moves at a second speed that is slower than the first speed of the first conveyor 68. The first and second conveyors 68, 70 are similar to those described in prior embodiments and are preferably driven by a common motor 72, although dedicated motors 72 driving the first and second conveyors 68, 70 at different speeds are also possible. The conveyors 68, 70 can be driven by an electric motor, a hydraulic motor, an internal combustion engine, by other driven equipment, and the like.

The first conveyor 68 and the second conveyor 70 are preferably coupled to the motor 72 by a first gear 74 and a second gear 76, respectively, such that the first conveyor 68 moves faster than the second conveyor 70. The first and second gears 74, 76 are preferably coupled to motor output gears 78A, 78B by belts 80A, 80B. The speed differential can be accomplished by a speed reducer located between the motor 72 and the second gear 76, a speed accelerator located between the motor 72 and the first gear 74, or a larger first gear 74 compared to the second gear 76. Any of these methods have the effect of creating different gear ratios between the first conveyor 68 and the second conveyor 70 such that the speed of the first conveyor 68 is different from the speed of the second conveyor 70. Likewise, the conveyors 68, 70 and the motor 72 need not be coupled by gears, but instead the motor 72 can be coupled to the conveyors 68, 70 by other methods known to those of ordinary skill in the art, such as by belts, chains, sprockets, cables, and the like. Any driving device, assembly, or mechanism operable to drive two conveyors 68, 70 at different speeds can be used as an alternative to the gear system described above and illustrated in FIG. 26.

A paddle conveyor 82 is preferably used in combination with multiple stacking apparatuses 10A, 10B. The paddle conveyor 82 is preferably located at downstream ends 86A, 86B of the first and second conveyors 68, 70 such that movement of the conveyors 68, 70 transfers the completed stacks from the downstream ends 86A, 86B of the conveyors 68, 70 to the paddle conveyor 82 near the downstream ends 86A, 86B of the conveyors 68, 70. Although not required, the paddle conveyor 82 can include a backstop 88 that stops the momentum of the stacks and prevents the transferred stacks from sliding past the paddle conveyor 82.

The paddle conveyor 82 preferably includes a plurality of paddles 90 that move transversely relative to the direction of movement of the conveyors 68, 70. The first conveyor 68 is preferably located in the upstream direction of the paddles 90 from the second conveyor 70 such that the paddles 90 will move past the downstream end 86B of the second conveyor 70 before the paddles 90 will move past the downstream end 86A of the first conveyor 68. The paddles 90 each preferably include a stem 92 that extends through a slot 94 in the paddle conveyor 82 and a pusher 96 that is connected to the stem 92 such that the pusher 96 contacts the stack and moves the stack in the direction of the paddles 90. The stems 92 of the paddles 90 are preferably connected to a paddle belt 98 below the paddle conveyor 82 such that the paddles 90 continuously raise up on an upstream end 100 of the paddle conveyor 82, move over the length of the paddle conveyor 82 to contact the stacks, and lower on the downstream end 102 of the paddle conveyor 82 to unload the stacks. The paddles 90 then preferably rotate below the paddle conveyor 82 along the length of the paddle belt 98 and return to the upstream end 100.

Figure 27:
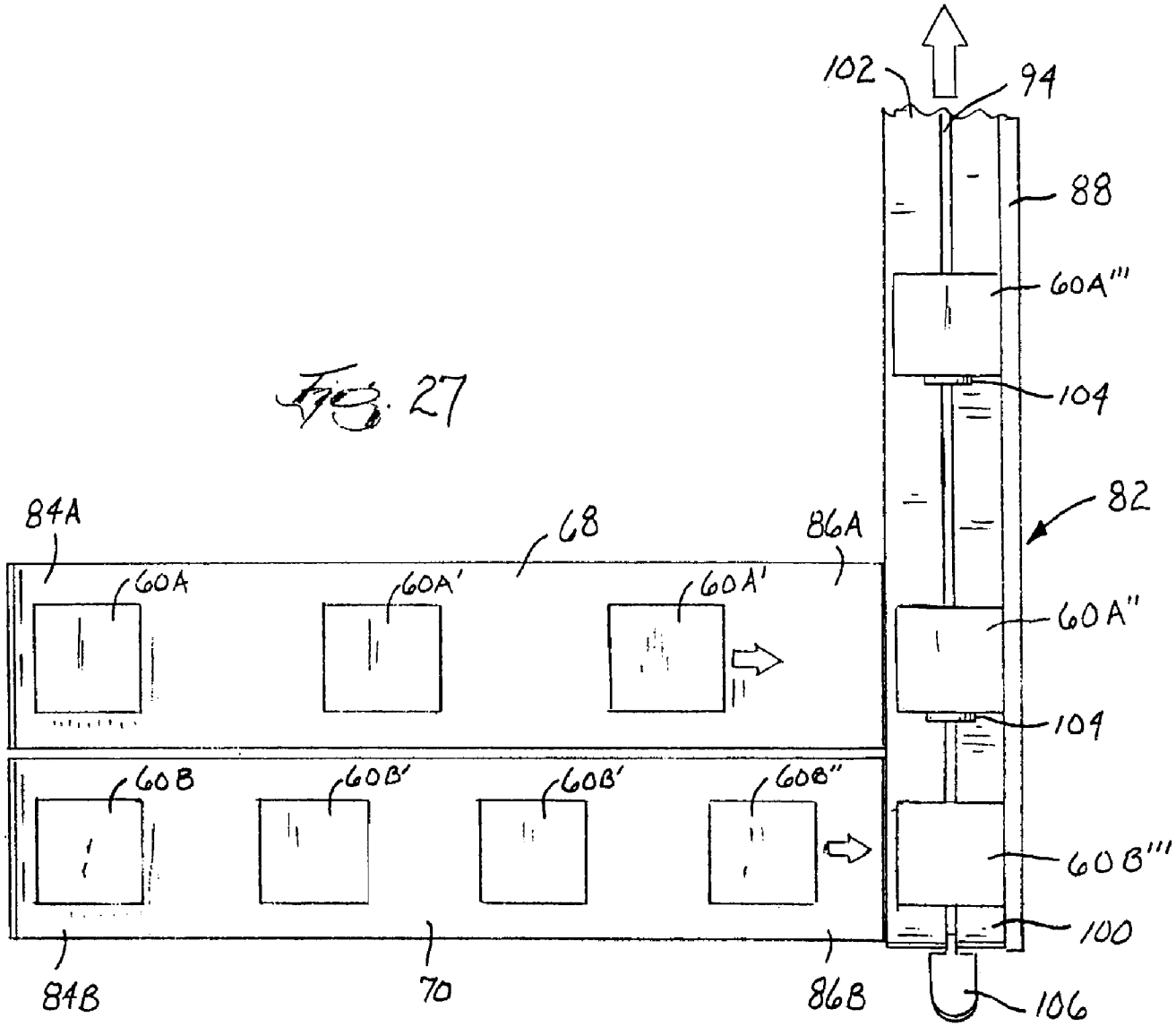
FIG. 27 is a top view of the first and second conveyor shown in FIG. 26.

The operation of this preferred embodiment of the present invention will now be described with reference to FIG. 25-27. Initially, the first stacking apparatus 10A discharges a first stack 60A onto the upstream end 86A of the first conveyor 68 and the second stacking apparatus 10B discharges a second stack 60B on the upstream end 86B of the second conveyor 70 at substantially the same time. The conveyors 68, 70 move the stacks 60A, 60B from the upstream ends 84A, 84B to the downstream ends 86A, 86B such that the second stack 60B' is moved toward the downstream end 86B of the second conveyor 70 at a speed that is less than the speed of the first stack 60A'. This speed differential permits the paddle conveyor 82 to receive and transport stacks of product away from the conveyors 68, 70 without interference between the stacks. By way of example only, such interference can otherwise result by employing a paddle conveyor 82 having paddles 90 spaced a shorter distance than the distance between centerlines of the conveyors 68, 70 (a possible design selection based upon downstream equipment, desired paddle conveyor speeds, and other considerations). The conveyors 68, 70 convey the stacks 60A, 60B to the paddle conveyor 82 where the stacks 60A, 60B preferably contact a backstop 88 to retain the stacks 60A, 60B on the paddle conveyor 82.

A number of different conventional devices and structures can be employed to improve the transfer of stacks 60A, 60B from the conveyors 68, 70 to the paddle conveyor 82. By way of example only, an air table (not shown) can be positioned between the downstream ends 86A, 86B of the conveyors 68, 70 and the paddle conveyor 82 in order to reduce friction beneath the stacks 60A, 60B and to allow the stacks 60A, 60B to more easily slide onto the paddle conveyor 82. Alternatively, part or all of the paddle conveyor 82 itself can be an air table provided with fluid under pressure (supplied to the surface of the table through apertures in the paddle conveyor 82) to perform this same function. In another embodiment, at least part of the paddle conveyor and/or at least part of the conveyors 68, 70 can be inclined to encourage stacks 60A, 60B to slide onto the paddle conveyor 82 from the conveyors 68, 70. In yet another embodiment, one or more driven or idler rolls can be located between the conveyors 68, 70 and the paddle conveyor 82. In other embodiments, one or more fingers, arms, plates, paddles, or other devices driven in any conventional manner can be actuated to sweep, push, pull, or otherwise move stacks 60A, 60B from the downstream ends 86A, 86B of the conveyors 68, 70 onto the paddle conveyor 82. Any other conveying device or system capable of transferring product between conveyors can be used to transfer the stacks 60A, 60B as described above.

After the first stack 60A" has been received on the paddle conveyor 82 (in some preferred embodiments, after a side of the first stack 60A" contacts the backstop 88), a first paddle 104 of the plurality of paddles 90 pushes the first stack 60A'" in the downstream direction of the paddles 90. Preferably, after the first paddle 104 passes the second conveyor 70 and the second stack 60B" can be transferred to the paddle conveyor 82 without interfering with the first paddle 104, the second stack 60B'" moves onto the paddle conveyor 82. Preferably in a manner similar to the first stack 60A, a second paddle 106 of the plurality of paddles 90 preferably pushes the second stack 60B'" in the downstream direction of the paddles 90. The conveyors 68, 70 and the paddles 104, 106 are preferably timed such that the second paddle 106 immediately follows the first paddle 104. However, the second paddle 106 can follow the first paddle 104 at any desired time after passage of the first paddle 104. Both of the stacks 60A'", 60B'" move downstream with the paddles 60A'", 60B'" until they are unloaded off of the downstream end 102 of the paddle conveyor 82 to be delivered to downstream operations (for example, to a wrapping apparatus, not shown).

Although the embodiment described above with reference to FIGS. 25-27 is shown comprising two stacking apparatuses 10A, 10B and two conveyors 68, 70 that move at different speeds, it is within the scope of the present invention to include more than two stacking apparatuses and more than two corresponding conveyors. The conveyors preferably move at different speeds to create a separation between the stacks at the downstream ends 86 of the conveyors so that the paddles 90 are allowed to move a single stack at a time without interfering with another stack.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the conveyor assembly described above and illustrated in FIGS. 25-27 preferably employs belt conveyors 68, 70 moving stacks 60A, 60B from the starwheels 20 and a paddle conveyor 82, 104, 106 moving stacks 60A, 60B from the belt conveyors 68, 70. Although belt conveyors 68, 70 and a paddle conveyor 82, 104, 106 are preferred, one having ordinary skill in the art will appreciate that other types of conveyors and conveying equipment can be employed to perform the same function (conveying two or more stacks of product away from a location and toward a conveyor at different speeds to enable the stacks to reach the conveyor at different times and to be carried away by the conveyor without interference between the stacks). Most preferably, the conveyors used to transport the stacks at different speeds move the stacks in a parallel or substantially parallel manner. Any conventional conveyor apparatus can be employed for this purpose (including those described above with reference to the embodiments of FIGS. 1-27), including without limitation belt, chain, tabletop, paddle, and bucket conveyors driven in any conventional manner. Similarly, although a paddle conveyor is preferred for transporting stacks 60A, 60B from the conveyors run at different speeds, any conventional conveyor apparatus such as those described above can be employed in place of the paddle conveyor 82, 104, 106.

Although the separator fingers 38, 46 are preferably driven by horizontal and vertical actuators (e.g., horizontal and vertical drive motors 128, 132, 136, 140 in some preferred embodiments) to enable the separator fingers 38, 46 to move in two dimensions, it should be noted that the actuators need not necessarily be horizontal and vertical to perform this function. Regardless of the type of actuators employed to move the separator fingers 38, 46, the actuators can be oriented in any other desired manner to facilitate two-dimensional movement of the separator fingers 38, 46. The separator fingers 38, 46 have vertical and horizontal ranges of motion in those cases where the actuators are oriented to move the separator fingers 48 in purely vertical and horizontal directions and in those cases where the actuators are oriented in other manners (e.g., diagonal actuation of the separator fingers 38, 46 still defines horizontal and vertical ranges of motion because the fingers 38, 46 are movable in some horizontal range and in some vertical range). Therefore, as used herein and in the appended claims, the terms "horizontal range of motion" and "vertical range of motion" are defined by purely horizontal and vertical motion, respectively, as well as any motion having horizontal and vertical components, respectively.

One having ordinary skill in the art will appreciate that any path of separator finger motion can be generated by actuation of either actuator or by simultaneous, substantially simultaneous, or staggered actuation of two or more actuators connected to the separator fingers 38, 46.

The paths of motion taken by the separator fingers 38, 46 in the present invention can be purely linear, such as three, four, or more connected straight or substantially straight paths of the separator fingers 38, 46. Alternatively, any one or more (or even all) of the paths of motion can be curved as desired and as needed to properly insert the separator fingers 38, 46 between the sheets of product in the starwheels 20 as described above and to retract the separator fingers 38, 46 as also described above. In one preferred embodiment for example, the separator fingers 38, 46 follow a quadrangular path (four paths joined by four discrete angles) which can be defined by purely straight lines of motion. In other preferred embodiments, the separator fingers 38, 46 follow a curved or complex path having any number of straight portions.

We claim:

1. An apparatus for moving stacks of product, the apparatus comprising:

a stacking assembly having a first separator finger movable from a retracted position to an extended position between first and second adjacent sheets within the stacking assembly, the first separator finger movable to support the first sheet to begin a first stack upon the first separator finger and to separate the first sheet from the second sheet completing a second stack, and a second separator finger movable independently of the first separator finger;

a first conveyor movable at a first speed, the first conveyor having an upstream end adjacent to the stacking assembly and positioned to receive product from the stacking assembly and having a downstream end;

a second conveyor positioned adjacent and parallel to the first conveyor, the second conveyor movable at a second speed, the second conveyor having an upstream end adjacent to the stacking assembly and positioned to receive product from the stacking assembly and having a downstream end, the downstream end of the first conveyor and the downstream end of the second conveyor being positioned at substantially equal distances from the upstream ends of the first conveyor and the second conveyor, respectively;

the first speed being faster than the second speed to move stacks of product on the first conveyor away from the stacking assembly at a faster speed than stacks of product on the second conveyor; and a third conveyor located adjacent and transverse to the first conveyor and the second conveyor, the third conveyor configured to receive stacks of product from the first conveyor and the second conveyor and to move stacks of product in the same direction without stacks of product from the first conveyor interfering with stacks of product from the second conveyor;

wherein the third conveyor is a paddle table having at least one paddle extending from the paddle table and movable relative to the first and second conveyors;

wherein the at least one paddle and the first and second conveyors are timed such that a stack of product is deposited on the first conveyor at the same time as a stack of product is deposited on the second conveyor, and the stack from the first conveyor is moved by a paddle before the stack from the second conveyor is moved by a paddle;

wherein the stack from the first conveyor and the stack from the second conveyor are moved by consecutive paddles of the third conveyor.

2. The apparatus of claim 1, further comprising a backstop adjacent to the third conveyor, the backstop positioned to limit stack movement in a direction toward the backstop when the stacks are at least partially positioned on the third conveyor.

3. The apparatus of claim 1, further comprising a motor driving the first and second conveyors.

4. The apparatus of claim 3, further comprising a first gear coupled between the motor and the first conveyor and a second gear coupled between the motor and the second conveyor, wherein the gear ratio between the motor and the first gear is different than the gear ratio between the motor and the second gear.

5. The apparatus of claim 1, wherein the first and second conveyors are positioned to receive the respective stacks at substantially the same time.

6. The apparatus of claim 1, wherein the first and second conveyors run in substantially the same direction.

7. An apparatus for moving stacks of product, the apparatus comprising:

a stacking assembly having a first separator finger movable from a retracted position to an extended position between first and second adjacent sheets within the stacking assembly, the first separator finger movable to support the first sheet to begin a first stack upon the first separator finger and to separate the first sheet from the second sheet completing a second stack, and a second separator finger movable independently of the first separator finger;

a first conveyor movable at a first speed, the first conveyor having an upstream end adjacent to the stacking assembly and positioned to receive product from the stacking assembly and having a downstream end;

a second conveyor positioned adjacent and parallel to the first conveyor, the second conveyor movable at a second speed, the second conveyor having an upstream end adjacent to the stacking assembly and positioned to receive product from the stacking assembly and having a downstream end, the downstream end of the first conveyor and the downstream end of the second conveyor being positioned at substantially equal distances from the upstream ends of the first conveyor and the second conveyor, respectively;

the first speed being faster than the second speed to move stacks of product on the first conveyor away from the stacking assembly at a faster speed than stacks of product on the second conveyor; and a third conveyor located adjacent and transverse to the first conveyor and the second conveyor, the third conveyor configured to receive stacks of product from the first conveyor and the second conveyor and to move stacks of product in the same direction without stacks of product from the first conveyor interfering with stacks of product from the second conveyor;

wherein the third conveyor is a paddle table having at least one paddle extending from the paddle table and movable relative to the first and second conveyors;

wherein the at least one paddle and the first and second conveyors are timed such that a stack of product is deposited on the first conveyor at the same time as a stack of product is deposited on the second conveyor, and the stack from the first conveyor is moved by a paddle before the stack from the second conveyor is moved by a paddle;

wherein the first conveyor is separated from the second conveyor in the direction motion of the plurality of paddles.

8. A method of moving stacks of product, the method comprising:

stacking product with a stacking assembly, the stacking assembly having a first separator finger and a second separator finger, the first separator finger movable from a retracted position to an extended position between first and second adjacent sheets within the stacking assembly, the second separator finger movable independently of the first separator finger;

discharging a stack onto an upstream end of a first conveyor, the first conveyor having a length;

discharging a stack onto an upstream end of a second conveyor, the second conveyor being substantially the same length of the first conveyor and positioned substantially parallel to the first conveyor;

moving the stacks on the first and second conveyors from the upstream ends of the first and second conveyors at substantially the same time;

moving the stack on the first conveyor a first distance to a downstream end of the first conveyor at a first speed;

moving the stack on the second conveyor a second distance substantially equal to the first distance to a downstream end of the second conveyor at a second speed slower than the first speed of the stack on the first conveyor;

receiving the stack from the first conveyor prior to the stack from the second conveyor by a third conveyor positioned substantially transverse to both the first conveyor and the second conveyor, wherein the third conveyor is a paddle table having at least one paddle extending from the paddle table and movable relative to the first and second conveyors, with the at least one paddle and the first and second conveyors being timed such that a stack of product is deposited on the first conveyor at the same time as a stack of product is deposited on the second conveyor, and the stack from the first conveyor is moved by a paddle before the stack from the second conveyor is moved by a paddle and the stack from the first conveyor and the stack from the second conveyor are moved by consecutive paddles of the third conveyor; and moving the first stack and the second stack onto the third conveyor in the same direction while maintaining a separation between the first stack and the second stack.

9. The method of claim 8, further comprising contacting a backstop with the stacks from the first and second conveyors when the stacks are at least partially received on the third conveyor.

10. The method of claim 8, further comprising moving the third conveyor in a transverse direction relative to the first and second conveyors.

11. The method of claim 8, further comprising driving the first and second conveyors with a motor.

12. The method of claim 11, further comprising:

driving a first gear located between the motor and the first conveyor; and driving a second gear located between the motor and the second conveyor, wherein the gear ratio between the motor and the first gear is different than the gear ratio between the motor and the second gear.

13. The method of claim 8, wherein discharging a stack on the first conveyor and discharging a stack on the second conveyor include passing the first separator finger through the upstream end of the first conveyor and passing the second separator finger through the upstream end of the second conveyor.

14. The method of claim 13, wherein the stacks are discharged on the first and second conveyors at substantially the same time.

* * * * *

UNITED STATES PATENT AND TRADEMARK OFFICE

CERTIFICATE OF CORRECTION

PATENT NO. : 7,364,398 B2
APPLICATION NO. : 10/996107
DATED : April 29, 2008
INVENTOR(S) : James R. Michler et al.

It is certified that error appears in the above-identified patent and that said Letters Patent is hereby corrected as shown below:

Page 3
Under U.S. PATENT DOCUMENTS, add the following
patents --980,385--
--1,985,676--
--4,181,052--
--4,190,241--
--4,349,188--
--4,647,265--
--4,842,573--
--4,921,235--
--5,144,306--
--6,165,116--
--6,322,315--

* See attached sheet for instructions only

Signed and Sealed this

Thirteenth Day of July, 2010

David J. Kappos

David J. Kappos
*Director of the United States Patent and Trademark Office*

PTO/SB/08A
Patent and Trademark Office: U.S. DEPARTMENT OF COMMERCE
Under the Paperwork Reduction Act of 1995, no persons are required to respond to a collection of information unless it contains a valid OMB control number.

OIPE JUL 1 9 2005

Substitute for form 1449/PTO

INFORMATION DISCLOSURE STATEMENT BY APPLICANT

(use as many sheets as necessary)

| Sheet | 1 | of | 1 |
|---|---|---|---|

| *Complete if Known* | |
|---|---|
| Application Number | 10/996,107 |
| Filing Date | November 23, 2004 |
| First Named Inventor | James R. Michler |
| Group Art Unit | 3653 |
| Examiner Name | Unknown |
| Attorney Docket Number | 019384-9139-01 |

U.S. PATENT DOCUMENTS

| Examiner Initials | | U.S. Patent Document Number | Name of Patentee or Applicant of Cited Document | Date of Publication of Cited Document |
|---|---|---|---|---|
| | | 6,322,315 | Schmidt, et al. | 11/27/2001 |
| | | 6,254,522 | Schmidt | 7/3/2001 |
| | | 6,165,116 | White | 12/26/2000 |
| | | 5,114,306 | Sjogren, et al. | 5/19/1992 |
| | | 4,921,235 | Biagiotti, et al. | 5/1/1990 |
| | | 4,842,573 | Peter, et al. | 6/27/1989 |
| | | 4,647,265 | Uno, et al. | 3/3/1987 |
| | | 4,349,188 | Young | 9/14/1982 |
| | | 4,190,241 | Krueger | 2/26/1980 |
| | | 4,181,052 | Kopp | 1/1/1980 |
| | | 3,531,108 | Gingras, et al. | 9/29/1970 |
| | | 1,985,676 | Hand | 12/25/1934 |
| | | 980,385 | Wollheim | 1/3/1911 |
| | | | | |
| | | | | |
| | | | | |
| | | | | |
| | | | | |

| Examiner Signature | Drew Williams | Date Considered | 2/1/06 |
|---|---|---|---|

EXAMINER: Initial if reference considered, whether or not citation is in conformance with MPEP 609. Draw line through citation if not in conformance and not considered. Include copy of this form with next communication to applicant.

Burden Hour Statement: This form is estimated to take 2.0 hours to complete. Time will vary depending upon the needs of the individual case. Any comments on the amount of time you are required to complete this form should be sent to the Chief Information Officer. Patent and Trademark Office, Washington, DC 0231.
DO NOT SEND FEES OR COMPLETED FORMS TO THIS ADDRESS. SEND TO: Commissioner for Patents, P.O. Box Alexandria, VA 22313-1450.